US005390632A

United States Patent [19]

Ikebe et al.

[11] Patent Number: 5,390,632

[45] Date of Patent: Feb. 21, 1995

[54] ENGINE COOLING SYSTEM

[75] Inventors: Hidehito Ikebe; Hiroyuki Niikura; Masaaki Hiratani; Hiroo Shimada; Koji Okazaki; Toshio Yokoyama, all of Saitama, Japan

[73] Assignee: Honda Giken Kogyo Kabushiki Kaisha, Tokyo, Japan

[21] Appl. No.: 19,969

[22] Filed: Feb. 19, 1993

[30] Foreign Application Priority Data

| | | | |
|---|---|---|---|
| Feb. 19, 1992 | [JP] | Japan | 4-032331 |
| Feb. 21, 1992 | [JP] | Japan | 4-035293 |
| Apr. 9, 1992 | [JP] | Japan | 4-088470 |

[51] Int. Cl.[6] ..... F01P 7/00

[52] U.S. Cl. ..... 123/41.02; 123/41.1; 123/41.13

[58] Field of Search ..... 123/41.1, 41.29, 41.44, 123/41.01, 41.02, 41.13, 41.21

[56] References Cited

U.S. PATENT DOCUMENTS

| | | | |
|---|---|---|---|
| 4,381,736 | 5/1983 | Hirayama | 123/41.1 |
| 4,557,223 | 12/1985 | Gueyen | 123/41.44 |
| 4,726,325 | 2/1988 | Itakura | 123/41.1 |
| 4,782,795 | 11/1988 | Kubozuka et al. | 123/41.21 |

FOREIGN PATENT DOCUMENTS

| | | |
|---|---|---|
| 0038556 | 10/1981 | European Pat. Off. . |
| 2388994 | 11/1978 | France . |
| 58-2418 | 8/1983 | Japan . |
| 64571 | 6/1989 | Japan . |
| 2149084 | 6/1985 | United Kingdom . |

OTHER PUBLICATIONS

European Search Report.

*Primary Examiner*—Noah P. Kamen
*Attorney, Agent, or Firm*—Lyon & Lyon

[57] ABSTRACT

An engine cooling system comprises a cooling water circulation circuit interconnecting an engine body and a radiator, a bypass circuit connected to the cooling water circulation circuit to bypass the radiator, an electric-powered water pump disposed in the cooling water circulation circuit adjacent an engine inlet, a flow rate control valve for controlling the flow rate of cooling water flowing through the radiator, an outlet water temperature detector for detecting an engine outlet water temperature in the cooling water circulation circuit, an inlet water temperature detector for detecting an engine inlet water temperature in the cooling water circulation circuit, and a control means for controlling the operation of the water pump in accordance with at least the engine outlet water temperature and controlling the operation of the flow rate control valve in accordance with at least the engine inlet water temperature to thereby properly control the temperature of the cooling water in accordance with the operational condition of the engine.

36 Claims, 24 Drawing Sheets

START
N1
READING OF
TWO, PA, TWR
N2
SEARCHING OF
OPERATIVE REGION
N3
OPERATIVE REGION ?
NO
YES
N5
SEARCHING OF
DUTY RATIO Do'
N6
OPENING OF FLOW RATE
CONTROL VALVE
N7
TWR ≧ TWRO ?
YES
NO
N8
FLOWING OF WATER THROUGH
HEATER UNIT;
OPERATION OF HEATER FAN
N9
OPERATION OF MOTOR
N4
STOPPAGE OF MOTOR
END

START
P1
NE >NESTD ?
NO
YES
P2
F ←1
P3
READING OF
NE, PB, TWO, TWI
P4
TWI >TWIS1 ?
NO
YES
P6
NO
TWI <TWIS2 ?
YES
P8
F =1 ?
NO
YES
P9
REWRITING OF F
ACCORDING TO MAP (1)
P10
REWRITING OF F
ACCORDING TO MAP (2)
P7
F ←0
P11
NO
F =1 ?
YES
P5
F ←1
P12
TSTD LAPSED ?
NO
YES
2
1

ENGINE COOLING SYSTEM

BACKGROUND OF THE INVENTION

1. Field of the Invention

The present invention relates to an engine cooling system in an internal combustion engine.

2. Description of the Prior Art

There is a conventionally known engine cooling system having an electric-powered variable displacement water pump provided adjacent an engine inlet in a cooling water circulation circuit interconnecting an engine body and a radiator. Such an engine cooling system is known, for example, from Japanese Patent Application Laid-open No. 2418/83. Further, an engine cooling system comprising a variable flow rate control valve provided in the cooling water circulation circuit to adjust the amount of cooling water flowing through the engine by controlling the opening degree of the control valve is also known, for example, from Japanese Patent Publication No. 571/89.

To precisely control the operation of the water pump to provide a cooling water temperature suitable for the operational condition of the engine by the cooling system disclosed in Japanese Patent Application Laid-open No. 2418/83, it is desired to effect a feed-back control of the operation of the water pump in accordance with the engine water temperature. In this case, the rapid warming-up of the engine can be achieved by effecting the feed-back control of the water pump in such a manner that the amount of cooling water flowing through the engine body is extremely small during warming-up of the engine. However, a value detected by a water temperature detector is incorrect due to the fact that the amount of cooling water flowing through the engine body during warm-up is extremely small. For this reason, in the engine cooling system using the feed-back control, it is difficult to increase the engine water temperature up to a desirable value, and the engine water temperature may be increased more than necessary, in some cases.

The present inventors have found, such as shown in FIG. 10, that for the purpose of avoiding the generation of engine knocking, it is effective to reduce the difference between an engine inlet water temperature and an engine outlet water temperature. However, in such a feed-back control as described above, it is difficult to optimally control the difference between the engine inlet water temperature and the engine outlet water temperature to avoid the generation of knocking.

In order to shorten the warming-up time and to avoid an over-cooled state, a target value for the engine outlet water temperature may be previously set at a relatively high level, and the opening degree of the control valve may be controlled, so as to bring the engine outlet water temperature to the target value. In the prior art system disclosed in the Japanese Patent Publication No. 571/89, in a normal operational condition, the opening degree of the control valve is controlled in accordance with the engine load and the engine speed so as to bring the temperature of a cylinder wall into a predetermined range, on the one hand, and during warming-up of the engine, the opening degree (the fully closed state) of the control valve is controlled so that the engine outlet water temperature is about 120° C., on the other hand. However, when the amount of the cooling water is controlled with only the engine outlet water temperature, the engine may become overheated. In the above prior art system, the temperature of the cylinder wall is detected directly, and the opening degree of the control valve is corrected by such detected value, so that the temperature of the cylinder wall is maintained within the predetermined range. For this reason, the arrangement of a control circuit is complicated.

SUMMARY OF THE INVENTION

Accordingly, it is an object of the present invention to provide an engine cooling system wherein the temperature of the cooling water can be controlled properly in accordance with the operational condition of the engine by a simple construction.

To achieve the above object, according to a first aspect and feature of the present invention, there is provided an engine cooling system comprising a cooling water circulation circuit interconnecting an engine body and a radiator, a bypass circuit connected to the cooling water circulation circuit to bypass the radiator, an electric-powered variable displacement water pump disposed in the cooling water circulation circuit adjacent an engine inlet, a flow rate control valve for controlling the flow rate of cooling water flowing through the radiator, an outlet water temperature detector for detecting the engine outlet water temperature in the cooling water circulation circuit, an inlet water temperature detector for detecting the engine inlet water temperature in the cooling water circulation circuit, and a control means for controlling the operation of the water pump in accordance with at least the engine outlet water temperature and controlling the operation of the flow rate control valve in accordance with at least the engine inlet water temperature.

With the above construction, the cooling water of an optimal amount dependent on the engine outlet water temperature is permitted to flow through the engine body, and moreover, the amount of cooling water flowing through the radiator and the amount of cooling water flowing through the bypass circuit can be controlled to insure an appropriate amount of the cooling water.

According to a second aspect and feature of the present invention, there is provided an engine cooling system comprising a cooling water circulation circuit interconnecting an engine body and a radiator, an electric-powered variable displacement water pump disposed in the cooling water circulation circuit adjacent an engine inlet, a water temperature detector for detecting the engine water temperature, and a control means for controlling the operation of the water pump in such a manner to switch-over a feed-back control according to the engine water temperature and an open loop control from one to another in accordance with the operational condition of the engine.

With the above construction, even if the engine is in an operational condition in which a value detected by the water temperature detector is incorrect, an appropriate amount of the cooling water is permitted to flow through the engine body, contributing to the proper control of the amount of the cooling water.

According to a third aspect and feature of the present invention, there is provided an engine cooling system comprising a cooling water circulation circuit interconnecting an engine body and a radiator, an electric-powered variable displacement water pump disposed in the cooling water circulation circuit adjacent an engine inlet, an engine outlet water temperature detector for detecting the engine outlet water temperature, a knocking detector for detecting the knocking of the engine, and a control means capable of performing a feed-back control of the water pump in accordance with the engine outlet water temperature and reducing the target value for the feed-back control, when engine knocking is detected.

With the above construction, the difference between the engine inlet water temperature and the engine outlet water temperature can be decreased to promptly eliminate the knocking.

According to a fourth aspect and feature of the present invention, there is provided an engine cooling system comprising a cooling water circulation circuit interconnecting an engine body and a radiator, a variable flow rate control valve mounted in the cooling water circulation circuit, an engine inlet water temperature detector for detecting the engine inlet water temperature, an engine outlet water temperature detector for detecting the engine outlet water temperature, and a control means capable of being switched over between a first control state for controlling the opening degree of the variable flow rate control valve to bring the engine outlet water temperature into a target outlet temperature, when the engine inlet water temperature is in a low water temperature level, and a second control state for controlling the opening degree of the variable flow rate control valve to bring the engine inlet water temperature into a target inlet temperature, when the engine inlet water temperature is in a high water temperature level.

With the above construction, it is possible to shorten the warming-up time and avoid the over-cooling by a simple construction.

The above and other objects, features and advantages of the invention will become apparent from the following description of preferred embodiments, taken in conjunction with the accompanying drawings.

DESCRIPTION OF THE PREFERRED EMBODIMENTS

The present invention will now be described by way of several preferred embodiments in connection with the accompanying drawings.

Figure 1:
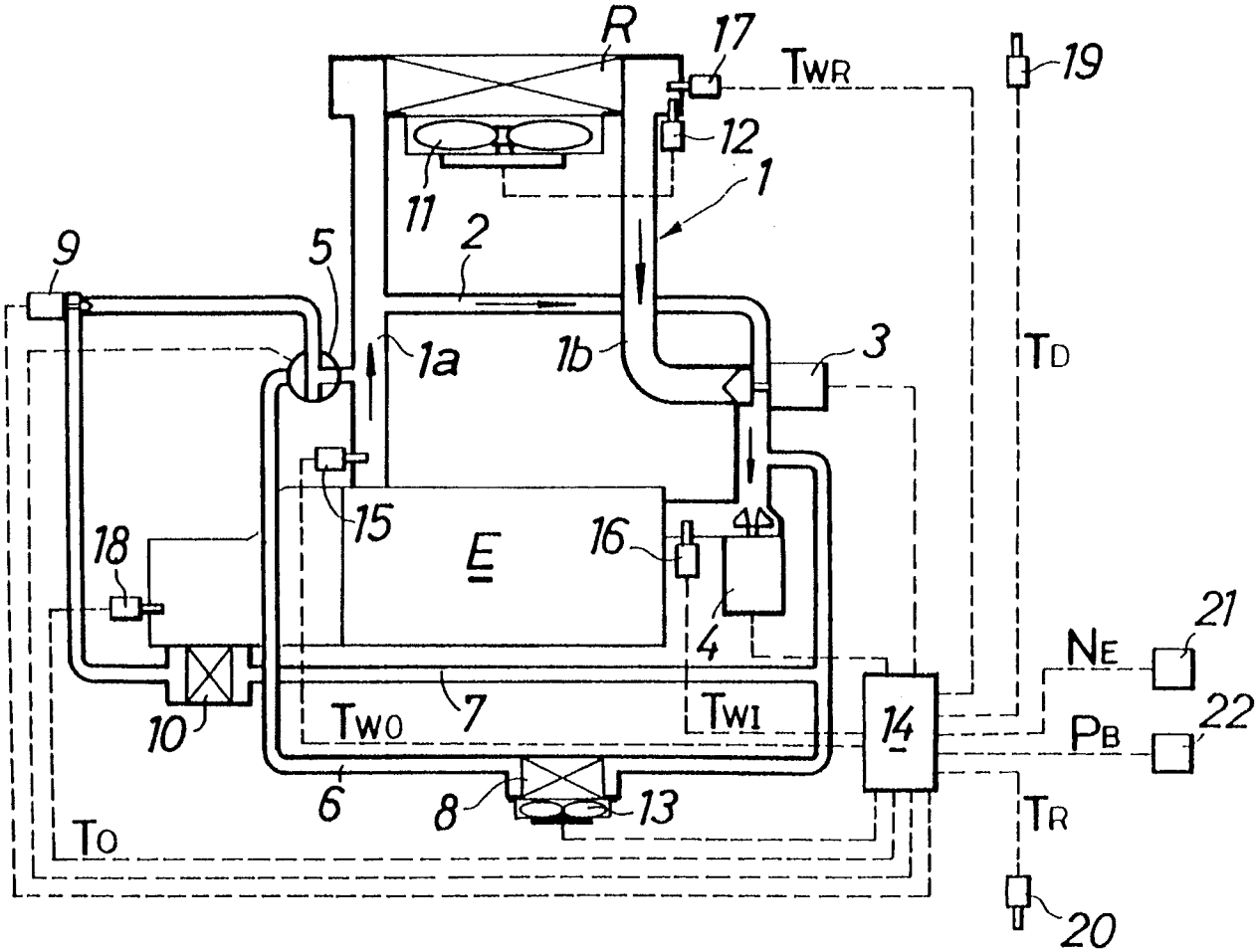
FIG. 1 is an illustration of the entire engine cooling system according to a first embodiment of the present invention.

Referring first to FIG. 1 illustrating a first embodiment of the present invention, a cooling-water circulation circuit 1 is constructed to connect an engine body E with a radiator R. The cooling-water circulation circuit 1 comprises a passage 1*a* interconnecting an outlet in the engine body E and an inlet in the radiator R, and a passage 1*b* interconnecting an outlet in the radiator R and an inlet in the engine body E. The passages 1*a* and 1*b* are interconnected by a bypass circuit 2 bypassing the radiator R.

A flow rate control valve 3, continuously variable in opening degree, is disposed in the middle of the passage 1*b* in the cooling-water circulation circuit 1. The bypass circuit 2 is connected to the passage 1*b* downstream of the flow rate control valve 3, i.e., at a point closer to the engine body E. An electric-powered variable displacement water pump 4 is disposed in the passage 1*b* adjacent the engine body E.

Lines 6 and 7 each are connected at one end to the passage 1*a* in the cooling-water circulation circuit 1 through a switchover valve 5 and at their other end to the passage 1*b* between the flow rate control valve 3 and the water pump 4. A heater unit 8 is provided in the middle of the passage 6. A control valve 9 and a transmission oil heat exchanger 10 are provided in sequence from the upstream side in the middle of the other passage 7.

A radiator fan 11 mounted adjacent the radiator R is controlled in an on-off manner by a fan switch 12 which is disposed adjacent the outlet of the radiator R. When the temperature of the water in the outlet of the radiator R becomes equal to or higher than a predetermined value, the radiator fan 11 is operated.

The flow rate control valve 3, the water pump 4, the switchover valve 5, the control valve 9 and the fan 13 mounted to the heater unit 8 are controlled by a control means 14 comprising a computer. Connected to the control means 14 are an outlet water temperature detector 15 for detecting the engine outlet water temperature $T_{WO}$ in the cooling-water circulation circuit 1 as an engine outlet water temperature, an inlet water temperature detector 16 for detecting the engine inlet water temperature $T_{WI}$ in the cooling-water circulation circuit 1, a radiator water temperature detector 17 for detecting the radiator water temperature $T_{WR}$ in the outlet of the radiator R, an oil temperature detector 18 for detecting the temperature $T_O$ of a transmission oil, an open-air temperature detector 19 for detecting the temperature $T_D$ of the open air, a compartment temperature detector 20 for detecting the temperature $T_R$ within a compartment, a revolution number or engine speed detector 21 for detecting the number of revolutions of the engine $N_E$ (rate of engine revolutions) and an intake pressure detector 22 for detecting engine intake pressure $P_B$ in the intake manifold of the engine or any other convenient location.

The control means 14 controls the operations of the flow rate control valve 3, the water pump 4, the switchover valve 5, the control valve 9 and the fan 13 in accordance with the above-described temperatures $T_{WO}$, $T_{WI}$, $T_{WR}$, $T_O$, $T_D$, and $T_R$, the engine speed $N_E$, as well as the engine intake pressure $P_B$. According to the present invention, the water pump 4 is controlled in accordance with at least the engine outlet water temperature $T_{WO}$, and the flow rate control valve 3 is controlled in accordance with at least the engine inlet water temperature $T_{WI}$. Control procedures established in the control means 14 for the control of the operations of the water pump 4 and the flow rate control valve 3 will be described below.

Figure 2:
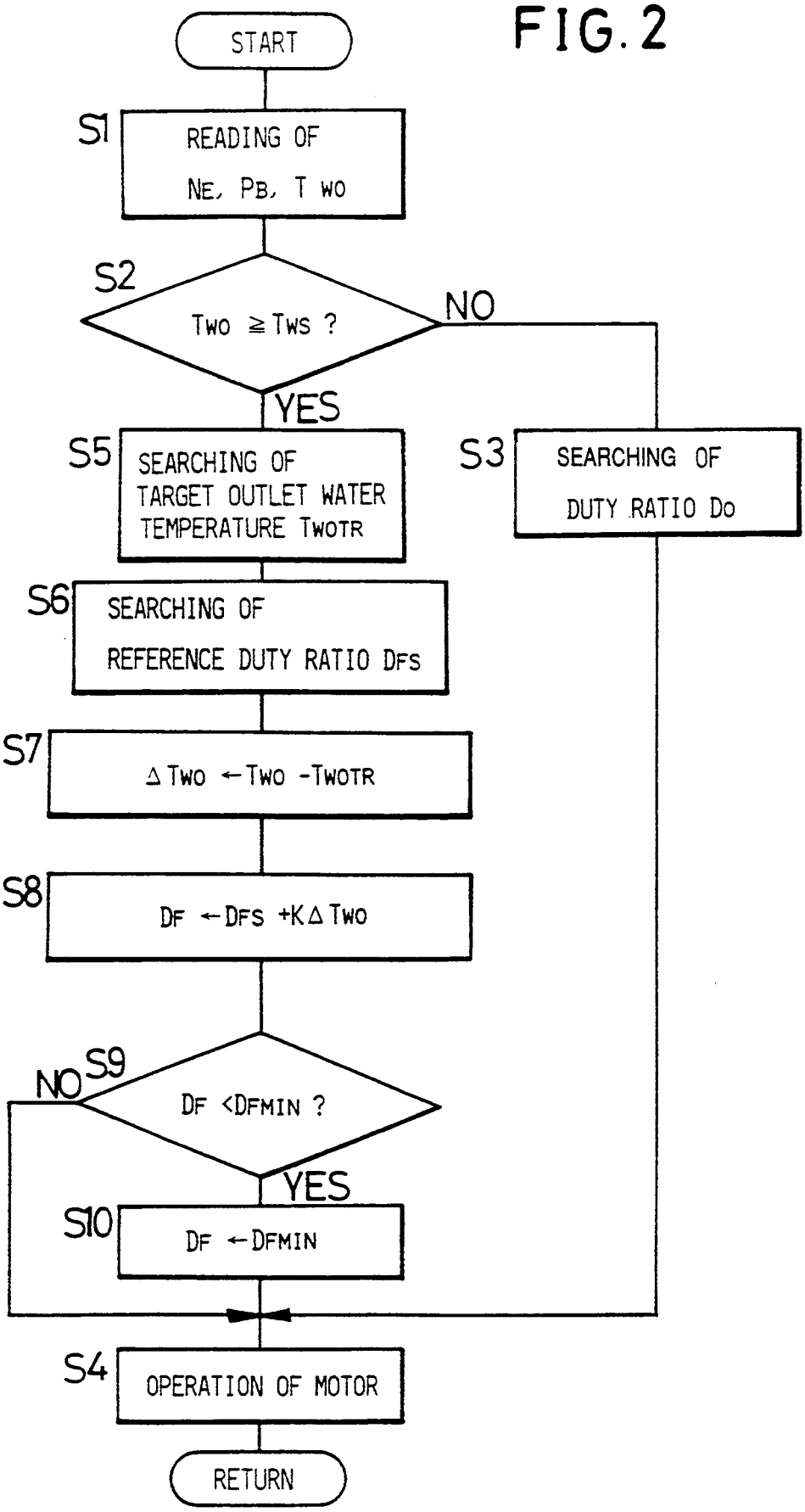
FIG. 2 is a flow chart illustrating a procedure for controlling the operation of a water pump.

FIG. 2 illustrates the control procedure established in the control means 14 to control the operation of the water pump 4 when the engine is in operation. At a first step S1, the engine speed $N_E$, the engine intake pressure $P_B$ and the engine outlet water temperature are read as parameters. At a second step S2, it is judged whether or not the engine outlet water temperature $T_{WO}$ is equal to or greater than a reference water temperature $T_{WS}$, e.g., 80° C. If it is decided "no" at the second step S2, i.e. that $T_{WO}<T_{WS}$, the processing is advanced to a third step S3.

Figure 3:
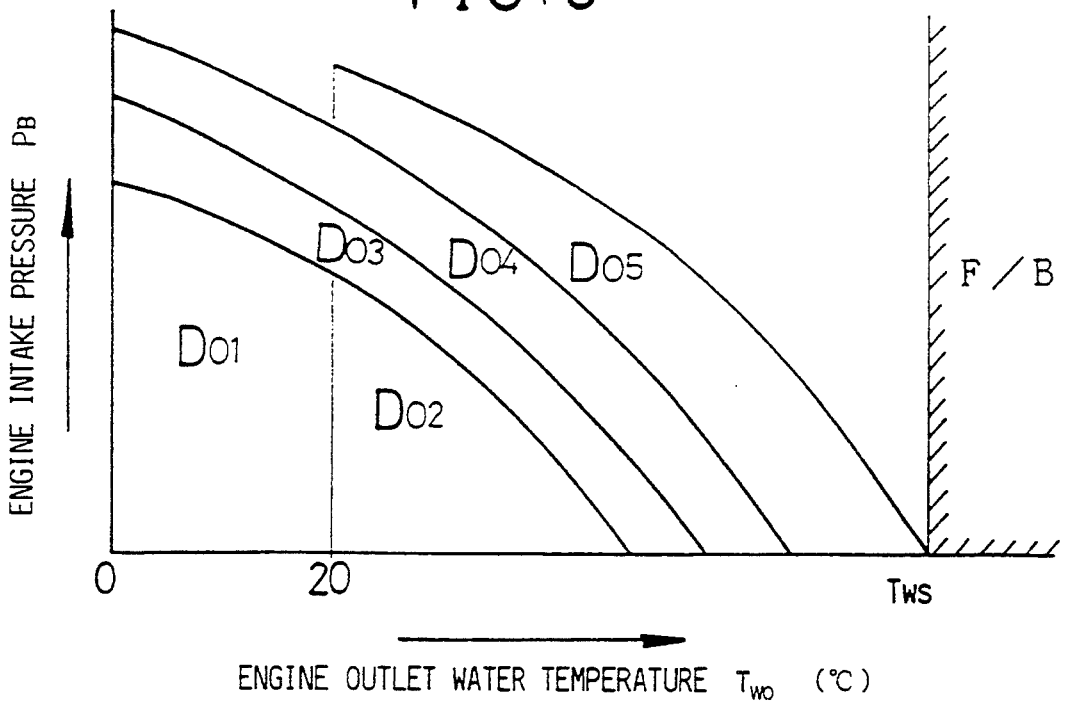
FIG. 3 is a diagram illustrating a map of duty ratios established for the procedure in an open loop control.

The motor for the water pump 4 is of an electric-powered type DC motor, and the displacement of the water pump 4 is varied by controlling the duty ratio of the motor. At the third step S3, the duty ratio $D_O$ is searched from a map which has previously been established in accordance with the relationship between the engine outlet water temperature $T_{WO}$ and the engine intake pressure $P_B$, as shown in FIG. 3. More specifically, a plurality of duty ratios such as $D_{01}$ (e.g., 5%), $D_{02}$ (e.g., 10%), $D_{03}$ (e.g., 20%), $D_{04}$ (e.g., 30%), $D_{05}$ (e.g., 40%) and the like have previously been established in accordance with the relationship of the valves of the engine outlet water temperature $T_{WO}$ and the engine intake pressure $P_B$. When the engine outlet water temperature $T_{WO}$ and the engine intake pressure $P_B$ are low, the duty ratio $D_O$ is set, for example, at about 5%. This value is an acceptable minimum value which insures a substantially uniform flow of the cooling water within the engine body E to produce no boiling within the engine body E.

Then, at a fourth step S4, the motor for the water pump 4 is operated on the basis of the searched duty ratio $D_O$. More specifically, the motor for the water pump 4 is controlled in an open loop by a fixed duty ratio determined in accordance with the engine outlet water temperature $T_{WO}$ and the engine intake pressure $P_B$, when the engine outlet water temperature $T_{WO}$ is lower than the reference water temperature $T_{WS}$.

Figure 4:
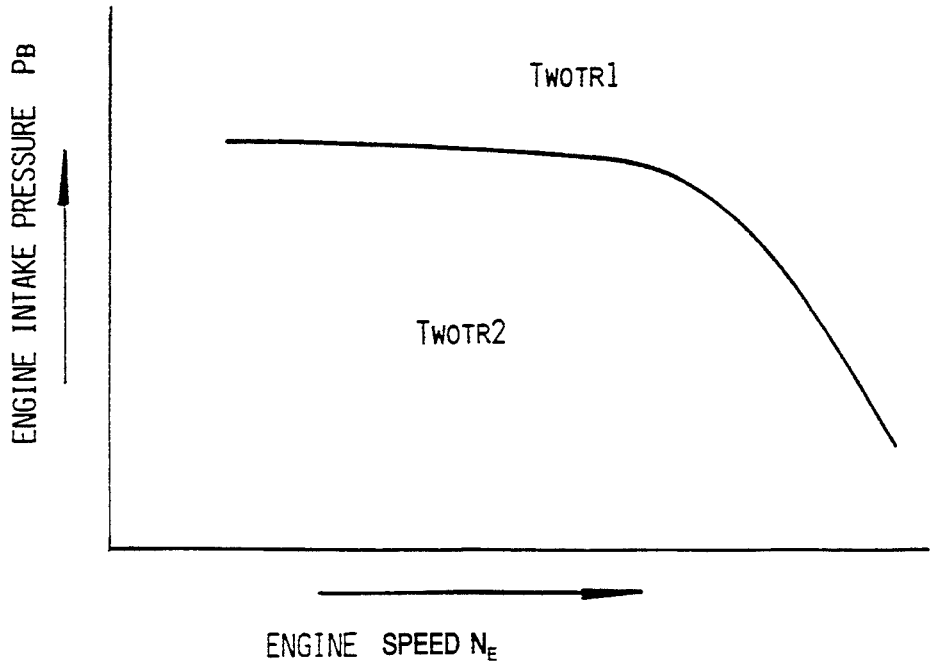
FIG. 4 is a diagram illustrating a map of target outlet water temperatures established for the procedure.

If it is decided at the second step S2 that $T_{WO} \geqq T_{WS}$, a feed-back control is carried out according to fifth to tenth steps S5 to S10. At the fifth step S5, a target outlet water temperature $T_{WOTR}$ is searched from a map which has previously been established in accordance with the engine speed $N_E$ and the engine intake pressure $P_B$, as shown in FIG. 4. In FIG. 4, a target outlet water temperature $T_{WOTR1}$ is set, for example, at 80° to 90° C., and a target outlet water temperature $T_{WOTR2}$ is set, for example, at 130° C.

Figure 5:
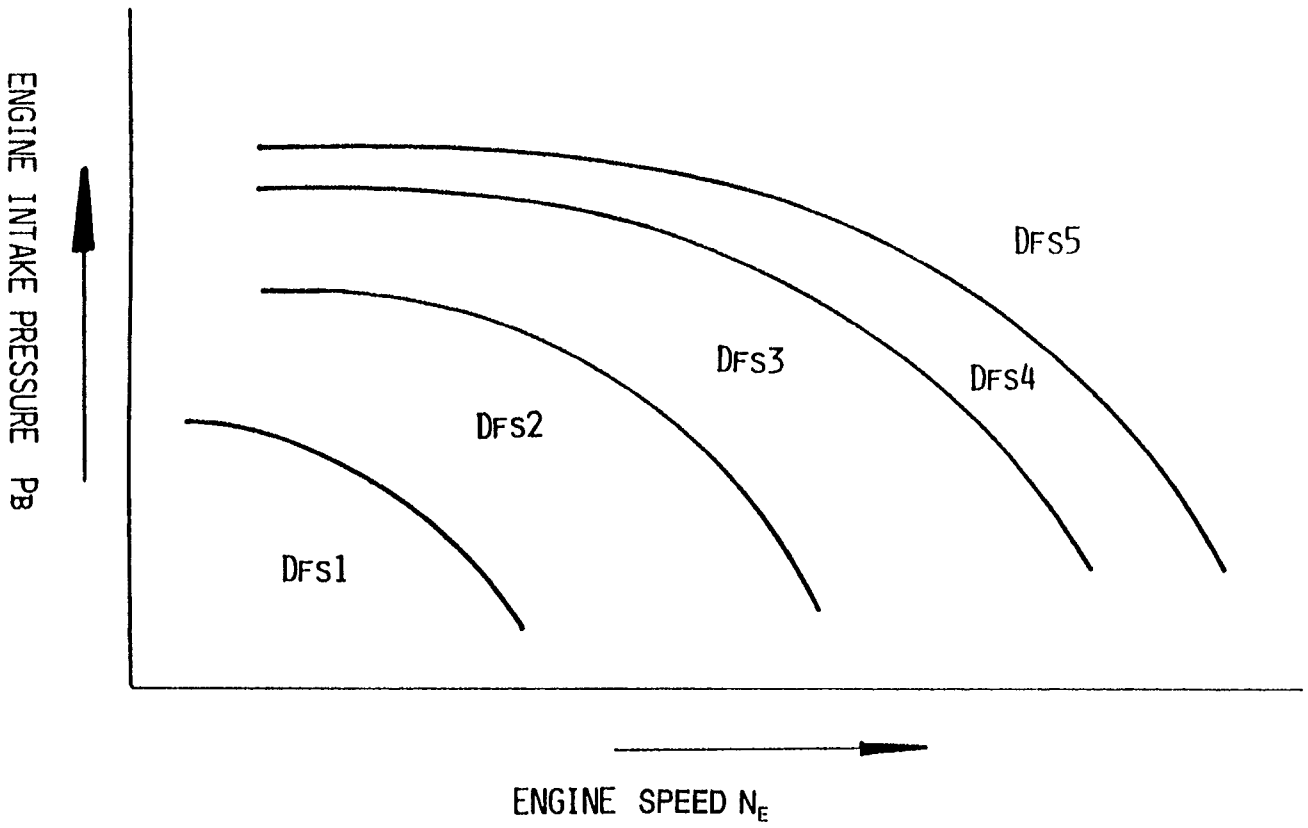
FIG. 5 is a diagram illustrating a map of reference duty ratios established for the procedure.

Then, a reference duty ratio $D_{FS}$ which has previously been set in accordance with the relationship between the engine speed $N_E$ and the engine intake pressure $P_B$ as shown in FIG. 5, is searched at a sixth step S6. As shown in FIG. 5, five regions $D_{FS1}$, $D_{FS2}$, $D_{FS3}$, $D_{FS4}$ and $D_{FS5}$ are established for the reference duty ratio $D_{FS}$ in accordance with the relationship between the engine speed $N_E$ and the engine intake pressure $P_B$. For example, $D_{FS1}$, is 5%; $D_{FS2}$ is 10%; $D_{FS3}$ is 20 to 50%; $D_{FS4}$ is 50 to 60%, and $D_{FS5}$ is 80 to 100%.

At a seventh step S7, a difference $\Delta T_{WO}$ of water temperature ($=T_{WO}-T_{WOTR}$) between the engine outlet water temperature $T_{WO}$ and the target outlet water temperature $T_{WOTR}$ is calculated. At a subsequent eighth step S8, a feed-back control value $D_F$ is calculated as ($D_{FS}+K\cdot\Delta T_{WO}$), wherein K is a gain.

At a ninth step S9, it is judged whether or not the feed-back control value $D_F$ obtained at the eighth step S8 is less than an acceptable minimum value $D_{FMIN}$. If $D_F<D_{FMIN}$, the feed-back control value $D_F$ is increased to $D_{FMIN}$ (i.e., $D_F=D_{FMIN}$) at a tenth step S10, the processing is advanced to the fourth step S4. If $D_F \geqq D_{FMIN}$, then the processing is directly advanced to the fourth step S4 to bypass the tenth step S10.

Figure 6:
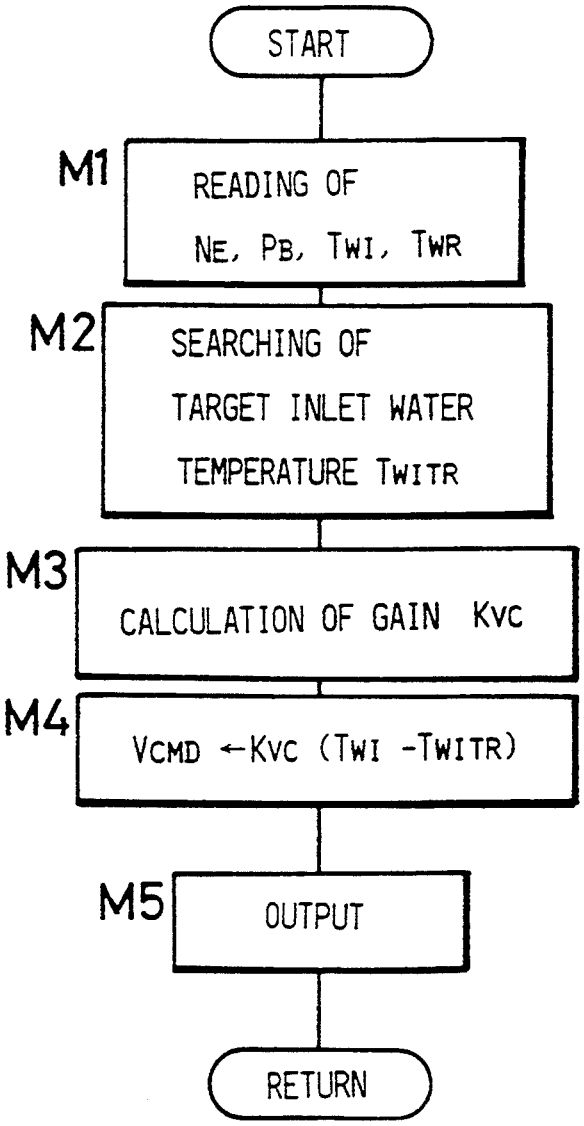
FIG. 6 is a flow chart illustrating a procedure for controlling the flow rate control valve.
Figure 7:
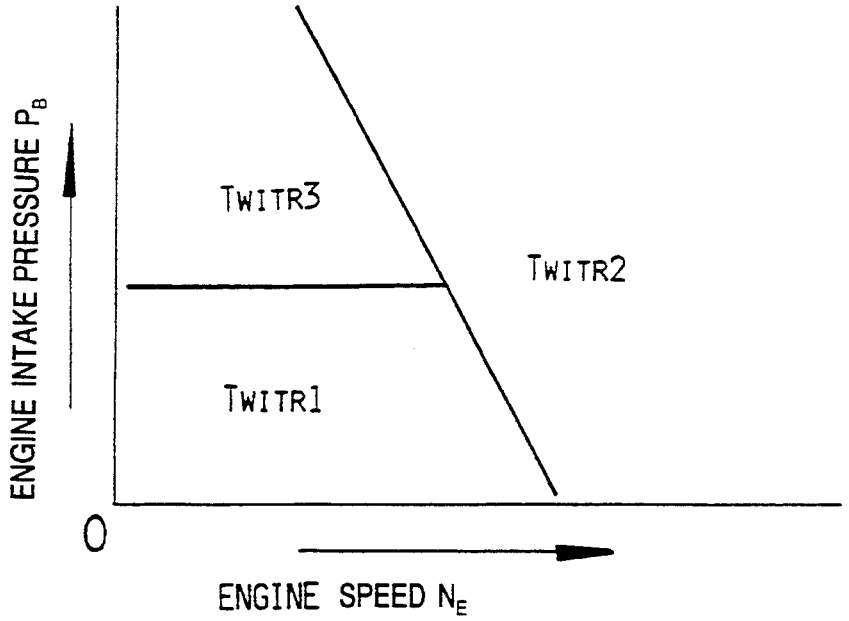
FIG. 7 is a diagram illustrating a map of target inlet water temperature established for the procedure.

FIG. 6 illustrates the control procedure established for the control means 14 to control the operation of the flow rate control valve 3 in the operated condition of the engine. At a first step M1, the engine speed $N_E$, the engine intake pressure $P_B$, the engine inlet water temperature $T_{WI}$ and the radiator water temperature $T_{WR}$ are read as parameters. Then, at a second step M2, a target inlet water temperature $T_{WITR}$ is searched from a map which has previously been established in accordance with the relationship between the engine revolution number $N_E$ and the engine intake pressure $P_B$, as shown in FIG. 7. In FIG. 7, a target inlet water temperature $T_{WITR1}$ is 110° C. for example; a target inlet water temperature $T_{WITR2}$ is 80° C., for example, and a target inlet water temperature $T_{WITR3}$ is 60° C., for example.

Figure 8:
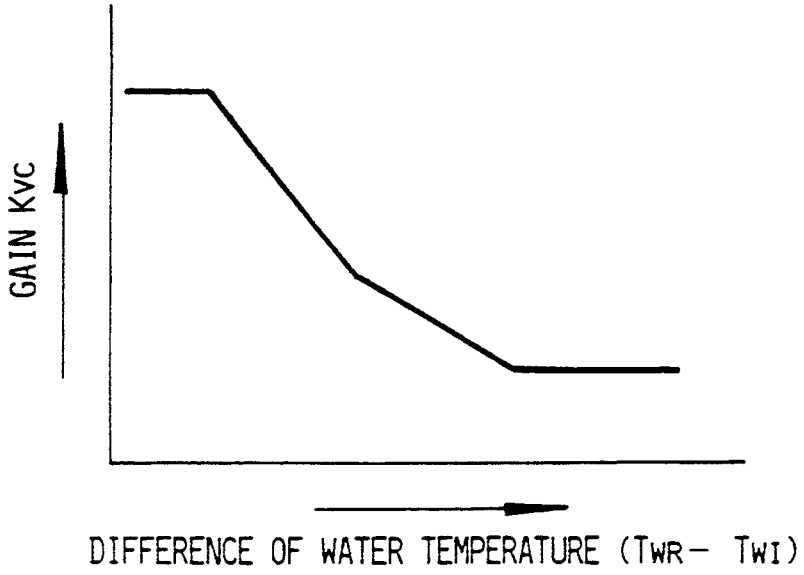
FIG. 8 is a diagram illustrating a map of gain established for the procedure.

At a third step S3, a gain $K_{VC}$ in the feed-back control of the flow rate control valve 3 is calculated in the accordance with the engine inlet water temperature $T_{WI}$ and the radiator water temperature $T_{WR}$. More specifically, the gain $K_{VC}$ has previously been set, as shown in FIG. 8, in accordance with a predetermined relationship of the difference ($T_{WR}-T_{WI}$) between the radiator water temperature $T_{WR}$ and the engine inlet water temperature $T_{WI}$, and the gain $K_{VC}$ is determined according to FIG. 8.

At a fourth step M4, a feed-back control opening degree $V_{CMD}$ of the flow rate control valve 3 is calculated. In other words, a calculation expression represented by $V_{CMD}=K_{VC}\cdot(T_{WI}-T_{WITR})$ is executed and at a next fifth step M5, the opening degree of the flow rate control valve 3 is controlled in accordance with the feed-back control opening degree $V_{CMD}$.

The operation of this embodiment now will be described. When the engine output water temperature $T_{WO}$ does not reach the reference water temperature $T_{WS}$ in an engine warming-up condition, the motor for the water pump 4 is controlled in the open loop on the basis of a fixed duty ratio $D_O$ which is determined in accordance with the engine outlet water temperature $T_{WO}$ and the engine intake pressure $P_B$. Moreover, when the engine outlet water temperature $T_{WO}$ is in a low temperature condition equal to or lower than 20° C., the duty ratio $D_O$ is set at a value as low as 5%, permitting only a small amount of cooling water to flow through the engine body E. Thus, the temperature of the cooling water will be increased rapidly up to the reference water temperature $T_{WS}$, with the temperature uniformized at various portions of the engine body E. In this case, the flow rate control valve 3 is in its closed state, so that the cooling water is not passed through the radiator R, but is permitted to flow through the bypass circuit 2.

When the engine is in a low load condition, the target outlet water temperature $T_{WOTR}$ in the feed-back control of the water pump 4 is set at a relatively high value, as high as 130° C., as shown in FIG. 4, and the target inlet water temperature $T_{WITR}$ in the feed-back control of the flow rate control valve 3 is set at a relatively high value, as high as 110° C., as shown in FIG. 7. This makes it possible to maintain the temperature of the cooling water in the engine body E at a relatively high level, and to provide a reduction in fuel consumption rate by a reduction in cooling loss and an improvement in atomization of the fuel. This avoids a deterioration of the nature of the exhaust gas.

Moreover, it is possible to control the amount of cooling water circulated by the water pump 4 to a minimum limit suitable for generating no boiling within the engine body E. A section upstream of the water pump 4 cannot be brought into a depressurized state, irrespective of the opening degree of the flow rate control valve 3 and therefore, boiling cannot occur in the cooling water circulation circuit 1.

Figure 9:
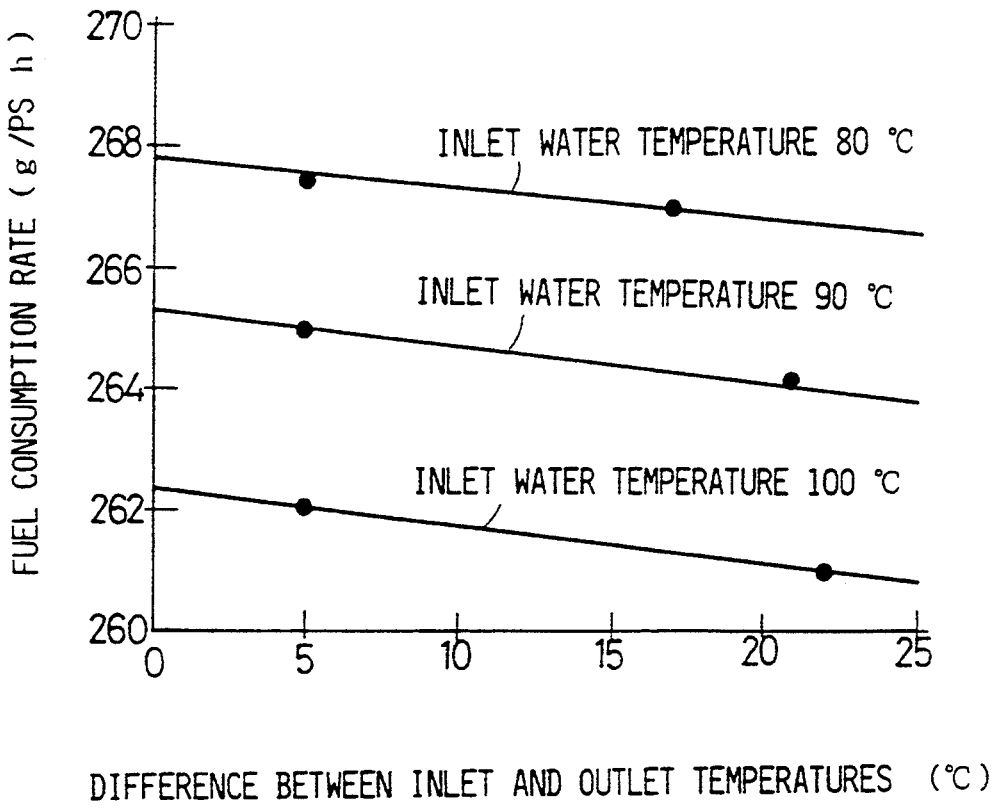
FIG. 9 is a diagram illustrating a fuel consumption rate characteristic based on the temperature of cooling water.
Figure 10:
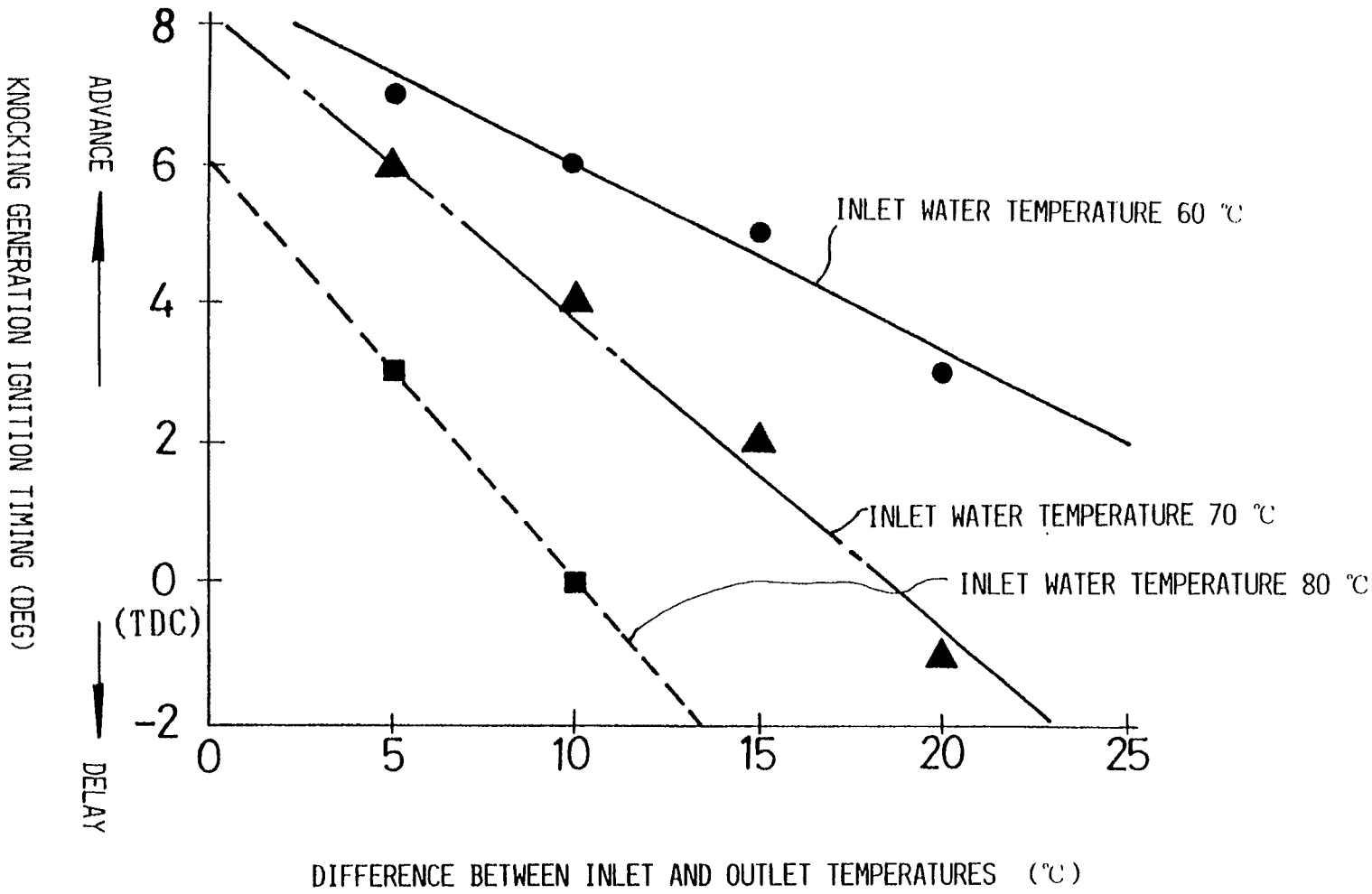
FIG. 10 is a graph illustrating a knocking generation ignition timing characteristic based on the temperature of cooling water.

When the engine is brought into a high load condition, an optimal value of the cooling water temperature exists, as shown in FIG. 9, for the purpose of providing a reduction in fuel consumption rate, and an optimal value of the cooling water temperature exists, as shown in FIG. 10, for the purpose of avoiding the generation of engine knocking. From the viewpoints of a reduction in fuel consumption rate, the avoidance of the generation of knocking and an increase in engine output, the temperature of the cooling water in the engine body E can be controlled by controlling the displacement of the water pump 4 in accordance with the engine outlet water temperature $T_{WO}$ and by controlling the opening degree of the flow rate control valve 3 in accordance with the engine inlet water temperature $T_{WI}$.

Because the gain $K_{VC}$ in the feed-back control of the flow rate control valve 3 is varied in accordance with the radiator water temperature $T_{WR}$ and the engine inlet water temperature $T_{WI}$, it is possible to control the ratio of the amount of cooling water flowing through the radiator R to the amount of cooling water flowing through the bypass circuit 2 to an optimal value to supply the cooling water having a temperature suitable for the load condition of the engine into the inlet of the engine body E.

A second embodiment of the present invention now will be described. In this embodiment, parts or components corresponding to those in the first embodiment are designated by like reference characters, and the detailed description thereof is omitted herein.

Figure 11:
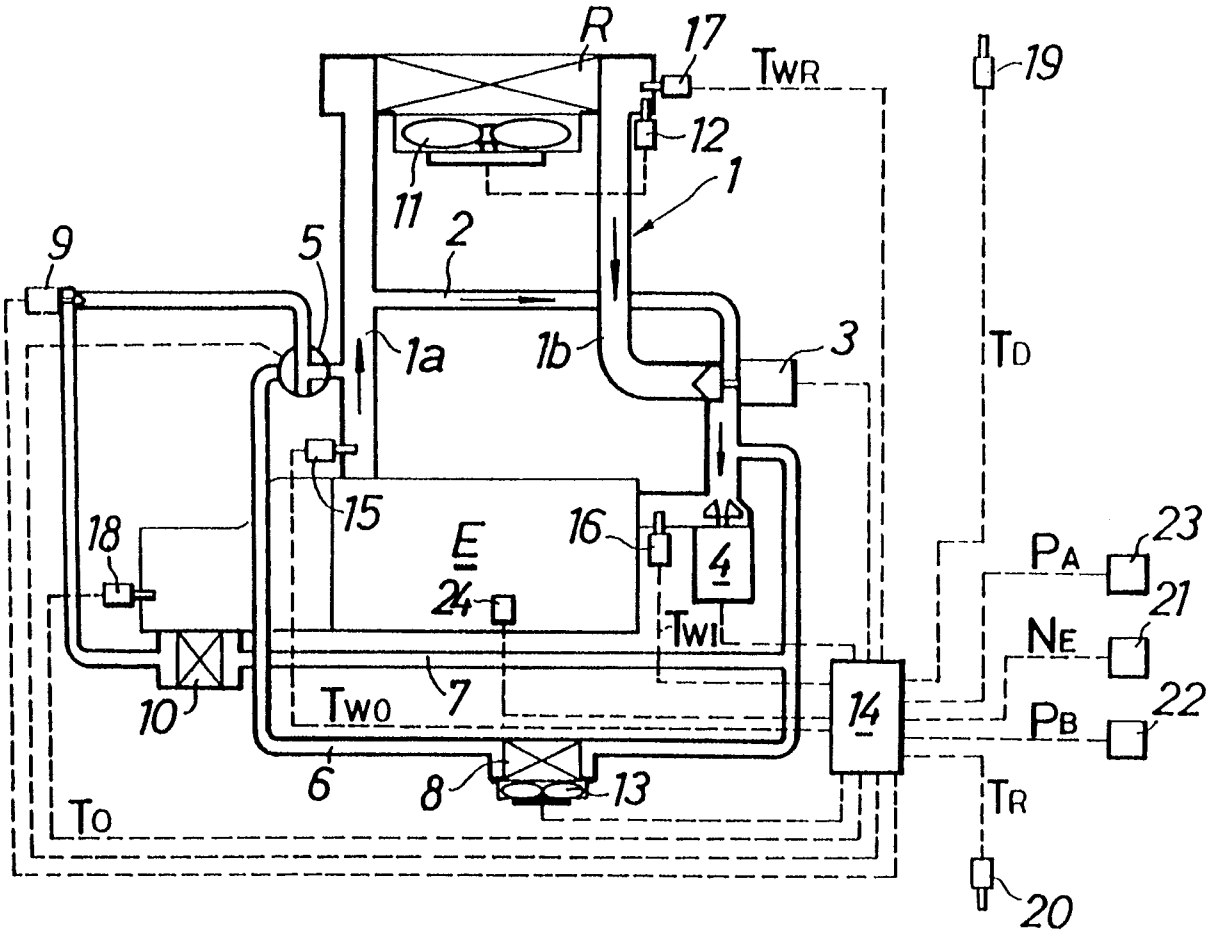
FIG. 11 is an illustration of the entire engine cooling system according to a second embodiment of the present invention.

As shown in FIG. 11, in addition to various detectors similar to those in the first embodiment, an atmospheric pressure detector 23 for detecting the atmospheric pressure $P_A$ and a knocking detector 24 for detecting the knocking by the vibration of the engine body E are connected to the control means 14.

Figure 12:
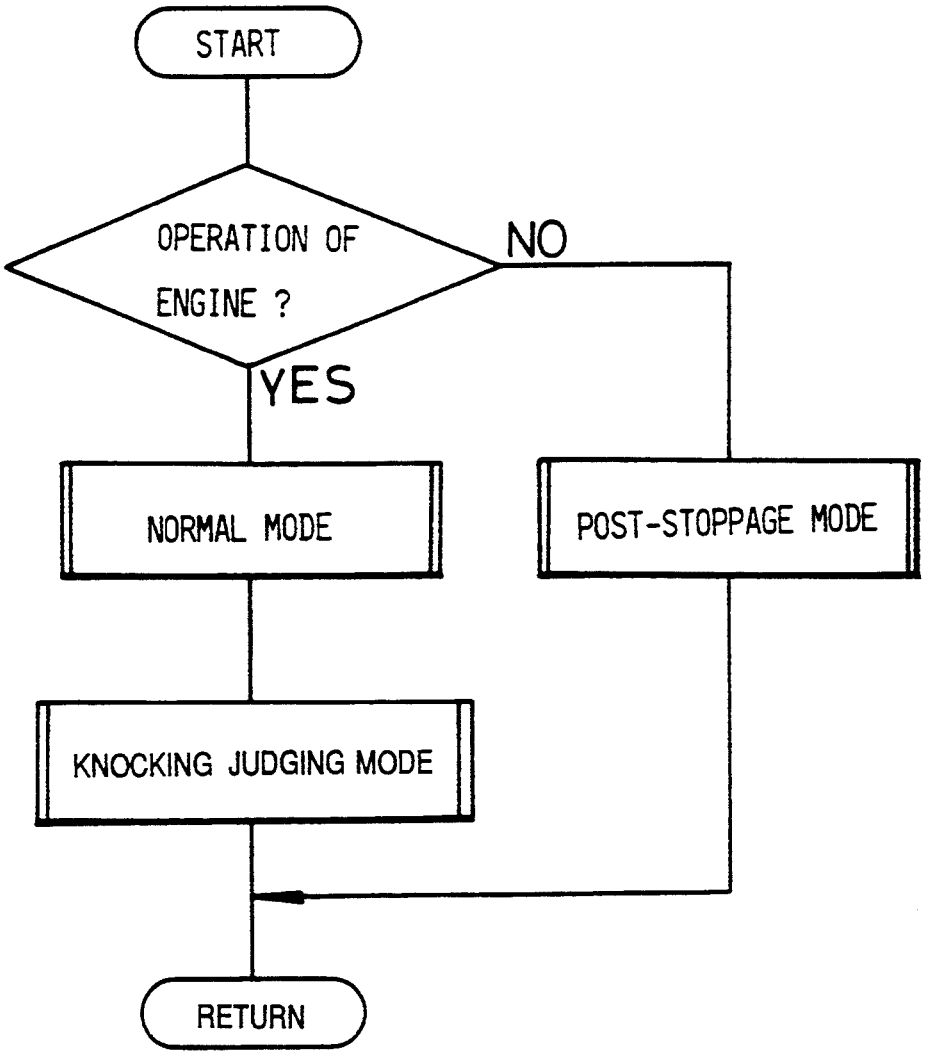
FIG. 12 is a flow chart of a main routine showing a procedure for controlling the operation of a water pump.

FIG. 12 illustrates a main routine of a control procedure established in the control means 14 to control the operation of the water pump 4. When the engine is in operation, controls according to a subroutine in a normal mode and according to a subroutine in a knocking judging mode are carried out, and when the operation of the engine is stopped, a control according to a subroutine in a post-stoppage mode is carried out. In the subroutine in the normal mode, the same control as the control of the operation of the water pump in the previous first embodiment is carried out (see FIGS. 2 to 5).

Figure 13:
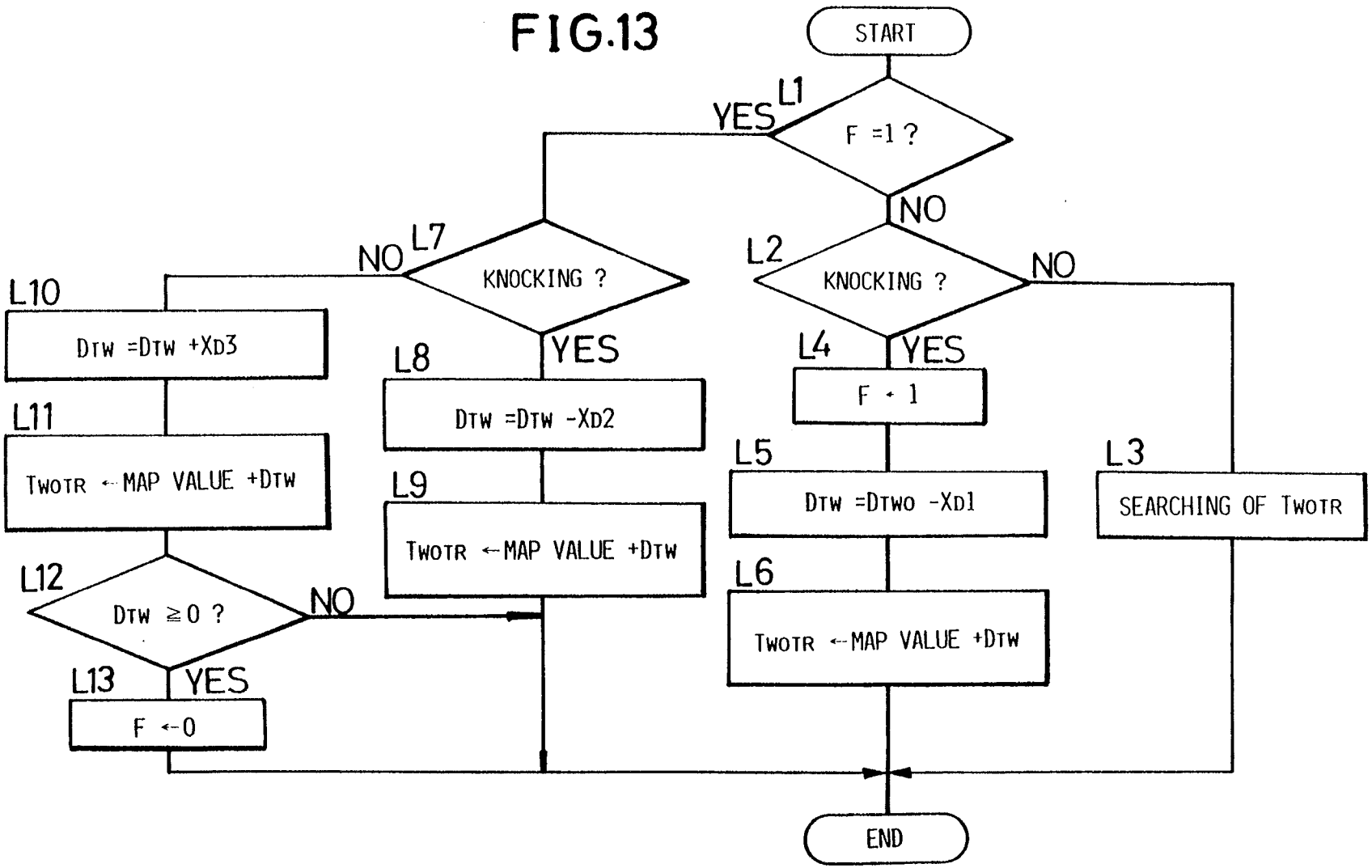
FIG. 13 is a flow chart illustrating a subroutine in a knocking judging mode.

FIG. 13 illustrates the subroutine in the knocking judging mode. At a first step L1, it is judged whether or not a flag F is equal to "1". This flag F indicates whether or not the engine is in a knocking state. F=1 indicates that the engine is in the knocking state, and F=0 indicates that the engine is in a non-knocking state. If F=0 at the first step L1, the processing is advanced to a second step L2. If F=1 at the first step L1, the processing is advanced to a seventh step L7.

At the second step L2, it is judged on the basis of an output from the knocking detector 24 whether or not there is a knocking produced. When there is no knocking produced, the processing is advanced to a third step L3, at which a target outlet water temperature is searched from the map shown in FIG. 4.

If it is decided at the second step L2 that there is the knocking produced, the flag F is set at "1" at a fourth step L4. Then, at a fifth step L5, a bias value $D_{TW}$ of the target outlet water temperature is calculated according to a calculation expression, $D_{TW}=D_{TWO}-X_{D1}$, wherein $D_{TWO}$ is, for example, 0° C., and $X_{D1}$ is, for example, 5° C. At a sixth step L6, the target outlet water temperature $T_{WOTR}$ is set at a value ($T_{WOTR}$=map value+$D_{TW}$) resulting from the addition of the bias value $D_{TW}$ to the map value shown in FIG. 4. In this case, the $D_{TW}$ is set at a negative value (e.g., −5° C.) at the fifth step L5 and hence, at the sixth step L6, a value reduced from the map value in FIG. 4 is set as the target outlet water temperature $T_{WOTR}$.

At the seventh step L7, it is judged on the basis of the output from the knocking detector 24 whether or not there is a knocking produced. If there is the knocking produced, the processing is advanced to an eighth step L8, at which a bias value $D_{TW}$ of the target outlet water temperature is calculated according to a calculation expression, $D_{TW}=D_{TW}-X_{D2}$), wherein $X_{D2}$ is, for example, 3° C. At a next ninth step L9, the target outlet water temperature $T_{WOTR}$ is set at a value ($T_{WOTR}$=map value+$D_{TW}$) resulting from addition of the bias value $D_{TW}$ obtained at the eighth step L8 to the map value shown in FIG. 4. In this case, the $D_{TW}$ is set at a negative value at the eighth step L8 and hence, at the ninth step L9, a value reduced from the map value in FIG. 4 is set as the target outlet water temperature $T_{WOTR}$.

If it is decided at the seventh step L7 that there is no knocking produced, a bias value $D_{TW}$ of the target outlet water temperature is calculated at a tenth step L10 according to a calculation expression, $D_{TW}=D_{TW}+X_{p3}$, wherein $X_{p3}$ is, for example, 1° C. At a next 11th step L11, the target outlet water temperature $T_{WOTR}$ is set at a value ($T_{WOTR}$=map value+$D_{TW}$) resulting from addition of the bias value $D_{TW}$ obtained at the tenth step L10 to the map value shown in FIG. 4. In this case, the $D_{TW}$ is determined by addition of, for example, 1° C. by 1° C. at the tenth step L10 and hence, the target outlet water temperature $T_{WOTR}$ is gradually restored to the map value in FIG. 4.

At a 12th step L12, it is judged whether or not the bias value $D_{TW}$ is equal to or more than 0 (zero). If $D_{TW} \geqq 0$, the flag F is set at "0" at a 13th step L13.

With such a subroutine in the knocking judging mode, when there is a knocking produced, the target outlet water temperature $T_{WOTR}$ is reduced from the map value, for example, by 5° C. at an initial stage of the knocking and thereafter, the target outlet water temperature $T_{WOTR}$ is reduced from the map value with the decrement gradually increased by 3° C. and by 3° C., until the knocking is eliminated. When the knocking has been eliminated, the target outlet water temperature $T_{WOTR}$ is reduced from the map value with the decrement reduced by, for example, 1° C. and by 1° C. When the decrement becomes "0" i.e., the target outlet water temperature $T_{WOTR}$ is restored to the map value, the flag F is set "0" returning to the normal mode.

Figure 14:
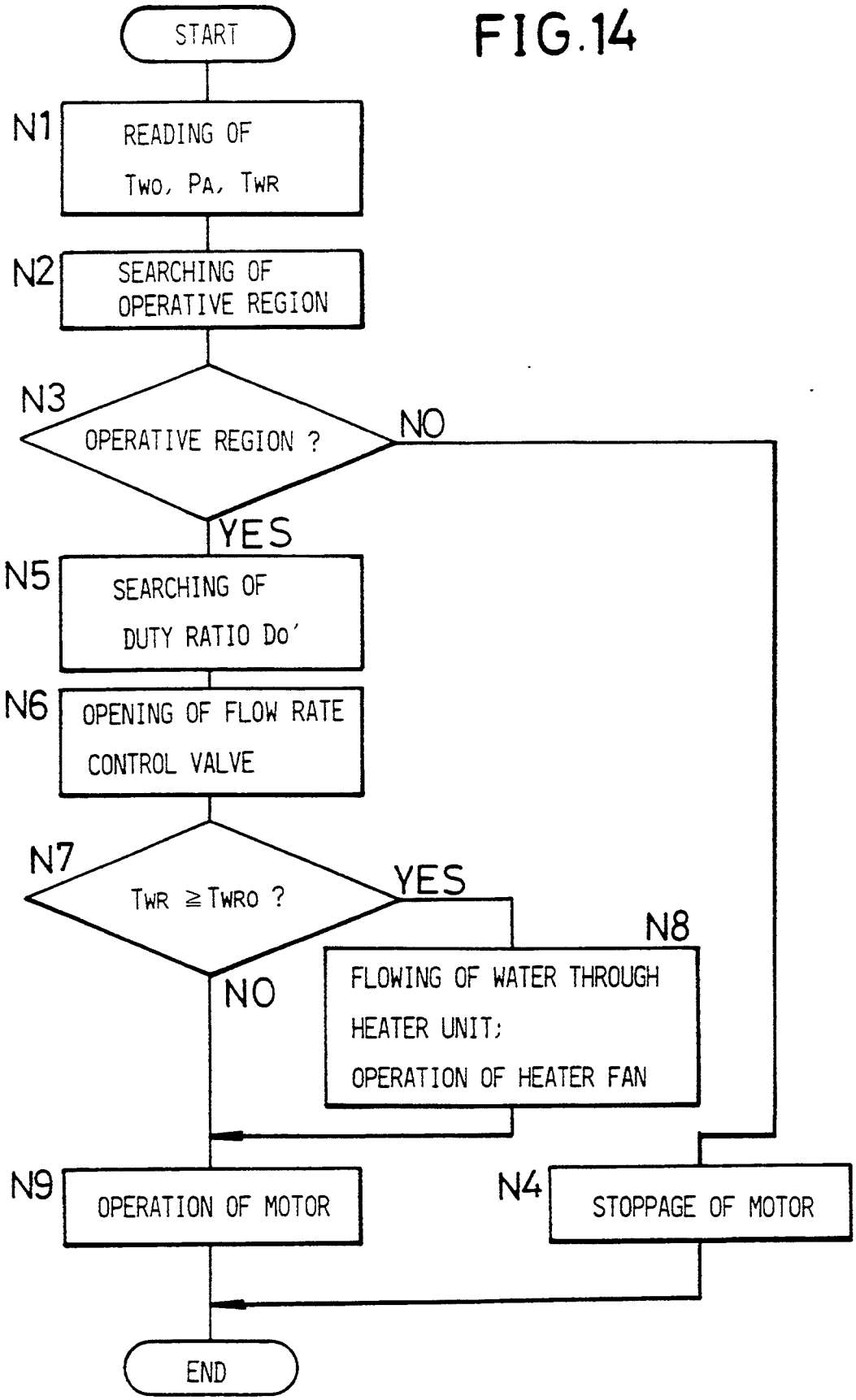
FIG. 14 is a flow chart illustrating a subroutine in a post-stoppage mode of the engine.
Figure 15:
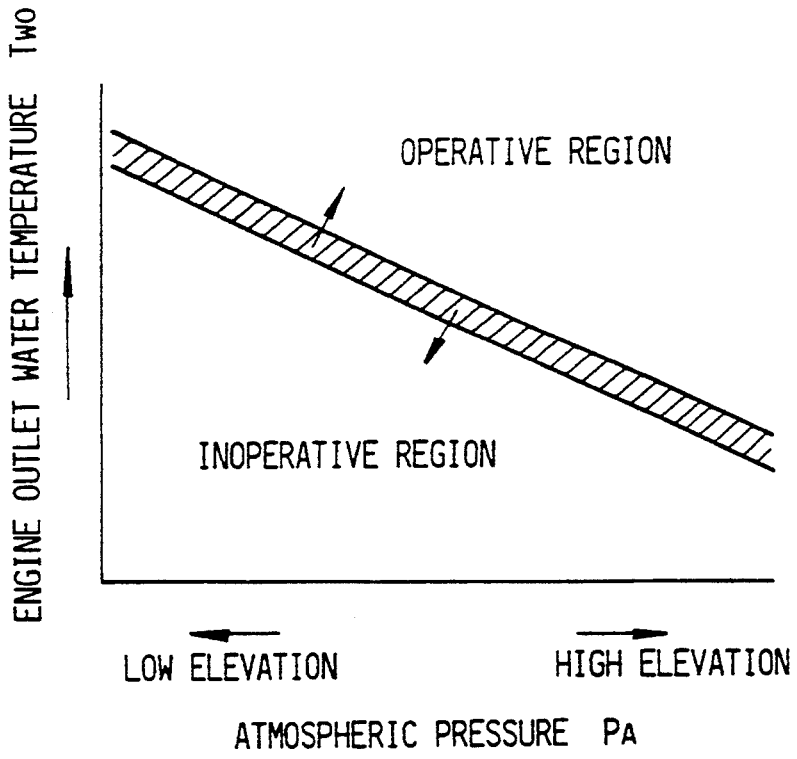
FIG. 15 is a diagram illustrating a map of operative region and inoperative region established after stoppage of an engine.

FIG. 14 illustrates the subroutine in the post-stoppage mode of the engine. At a first step N1, the engine output water temperature $T_{WO}$, the atmospheric pressure $P_A$ and the radiator water temperature $T_{WR}$ are read as parameters. At a second step N2, an operative region is searched. That is, as shown in FIG. 15, the operative region and an inoperative region according to the atmospheric pressure $P_A$ and the engine output water temperature $T_{WO}$ have previously been established with a hysteresis region (a region indicated by oblique lines in FIG. 15) provided therebetween. At a third step N3, it is judged whether or not the engine is in the operative region in which the engine output water temperature $T_{WO}$ is higher and the atmospheric pressure PA is lower (i.e., the vehicle is travelling at a higher elevation). If it is decided that the engine is in the inoperative region, the operation of the water pump 4 is stopped at a fourth step N4. On the other hand, if it is decided that the engine is in the operative region, the processing is advanced from the third step N3 to a fifth step N5.

Figure 16:
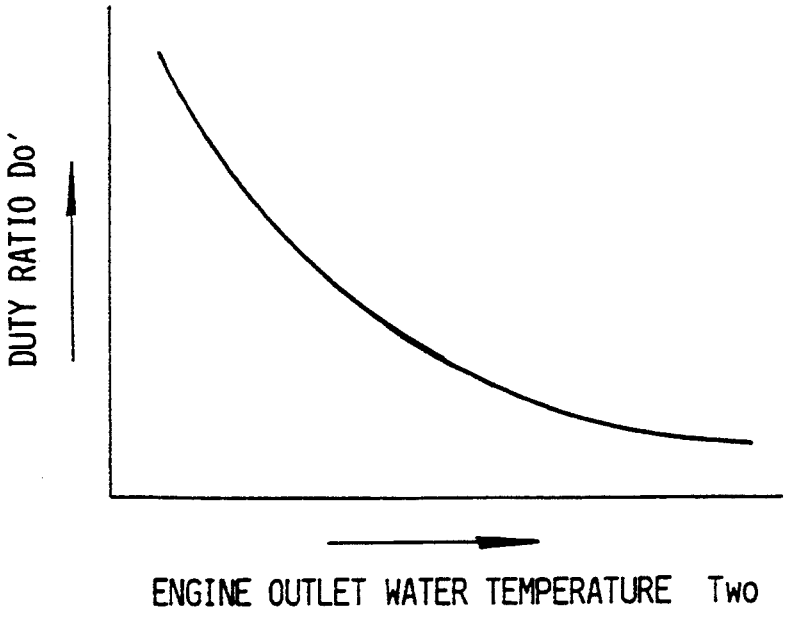
FIG. 16 is a diagram illustrating a map of duty ratio established in an open loop control after stoppage of the engine.

At the fifth step N5, the duty ratio $D_O'$ of the motor for the water pump 4 is searched from a map which has previously been established in accordance with the engine output water temperature $T_{WO}$, as shown in FIG. 16. The duty ratio $D_O'0$ is set so that it is continuously reduced with increase in engine output water temperature $T_{WO}$, when the operation of the engine is stopped. After stoppage of the engine, the control value in the open loop control of the water pump 4 is continuously varied in accordance with the engine output water temperature $T_{WO}$.

At a sixth step N6, the flow rate control valve 3 is forcibly opened, so that most of the cooling water that has been increased in temperature in the engine body E is permitted to flow through the radiator R.

At a seventh step N7, it is judged whether or not the radiator water temperature $T_{WR}$ becomes equal to or higher than a preset water temperature $T_{WRO}$. This preset water temperature $T_{WRO}$ is set higher than a temperature at which the radiator fan 11 mounted to the radiator R is operated by the fan switch 12. If $T_{WR}<T_{WRO}$, the processing is advanced to a ninth step N9. If $T_{WR} \geqq T_{WRO}$, the processing is advanced through an eighth step N8 to the ninth step N9.

At the eighth step N8, the cooling water is permitted to flow through the passage 6 having the heater unit 8 by the switchover valve 5 (see FIG. 11), and the fan 13 applied to the heater unit 8. More specifically, when the radiator water temperature $T_{WR}$ is not reduced even if the radiator fan 11 is operated, a portion of the cooling water is permitted to flow through the heater unit 8, so that releasing of heat from the cooling water is promoted by the fan 13.

At the ninth step N9, the motor for the water pump 4 is controlled in the open loop by using the duty ratio $D_O'$ obtained at the fifth step N5 as the control value.

The control procedure for controlling the flow rate control valve 3 in the engine-operated condition is the same as in the previously described first embodiment (see FIGS. 6 to 8).

With the construction of the second embodiment, in addition to the operation of the previously described first embodiment, the target value of the feed back control for the water pump 4, i.e., the target outlet water temperature $T_{WOTR}$ is reduced when the knocking detector 24 has detected the knocking. Therefore, when the knocking is generated, a difference between the engine inlet temperature $T_{WI}$ and the engine outlet water temperature $T_{WO}$ is decreased. When this difference is decreased as shown in FIG. 10, the knocking is difficult to generate, and hence, it is possible to promptly eliminate the knocking phenomenon after it has started to be generated, by reducing the target outlet water temperature $T_{WOTR}$.

In addition, since the operation of the water pump 4, after stoppage of the engine, is controlled in the open loop by use of the control value which is continuously varied in accordance with the engine outlet water temperature $T_{WO}$, it is possible to smoothly vary the amount of cooling water circulated as a result of cooling of the engine body E, to prevent the build-up of heat from being produced within the engine body E and to prevent the boiling of the cooling water and the failure of the starting of the engine at the restart thereof.

Although the opening degree of the flow rate control valve 3 has been controlled in accordance with the engine inlet water temperature $T_{WI}$ in the above-described second embodiment, it is to be understood that a thermostat opened at a given temperature may be used. In this case, the sixth step N6 in the flow chart shown in FIG. 14 is unnecessary.

Figure 17:
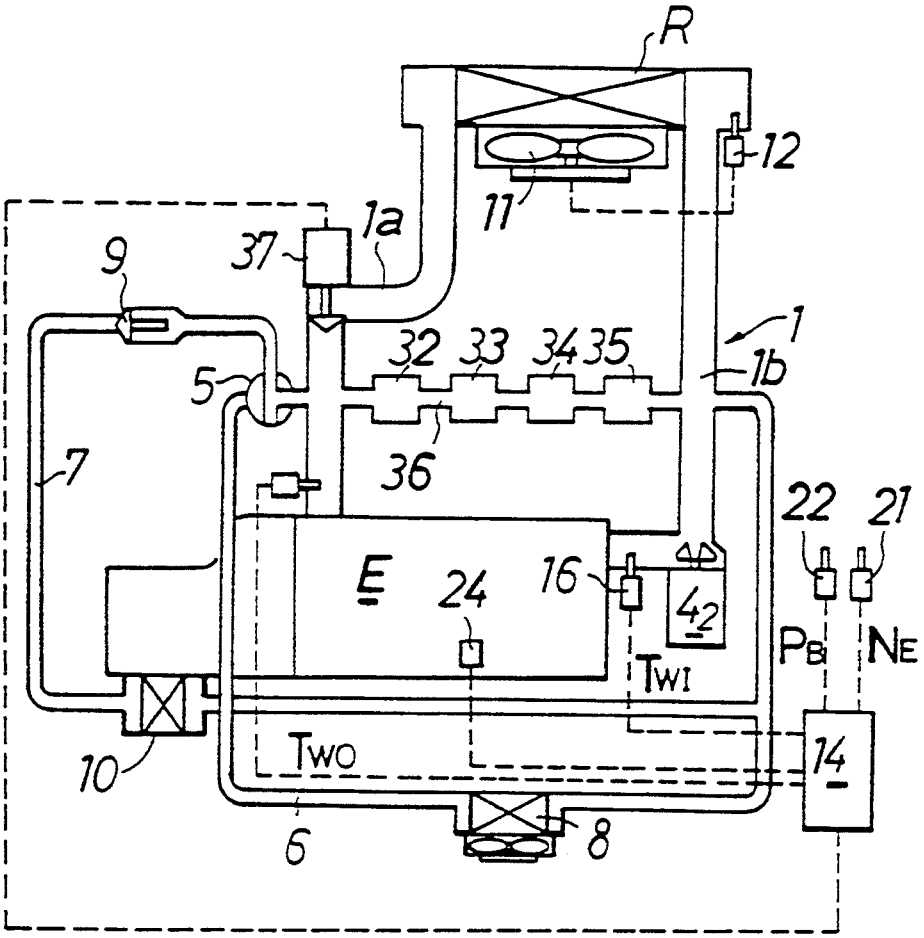
FIG. 17 is an illustration of the entire engine cooling system according to a third embodiment of the present invention.

Further, a third embodiment of the present invention now will be described. Referring first to FIG. 17, a cooling water circulation circuit 1 is constructed to connect an engine E and a radiator R to each other. The cooling water circulation circuit 1 comprises a passage 1*a* interconnecting an outlet in the engine E and an inlet in the radiator R, and a passage 1*b* interconnecting an outlet in the radiator R and an inlet in the engine E. The passages 1*a* and 1*b* are interconnected by a riser passage 36 which passes adjacent to and serves to control the temperature of a first idle valve 32 for automatically controlling the amount of air bypassing a throttle valve (not shown), an air control valve 33 for controlling the amount of air bypassing the throttle valve in response to a control signal, a throttle body 34 including a throttle valve, and a breather passage 35 together in series to bypass the radiator R.

An electromagnetic variable flow rate control valve 37, continuously variable in opening degree, is disposed in the passage 1*a* in the cooling water circulation circuit 1 at a location closer to the radiator R than the junction with the riser passage 36. A water pump $4_2$ is disposed in the passage 1*b* in the cooling water circulation circuit 1 at a location closer to the engine E than riser passage 36 and the pump is connected to a crank shaft (not shown) of the engine.

Passages 6 and 7 each are connected at one end thereof to the passage 1*a* in the cooling water circulation circuit 1 and at the other end thereof to the passage 1*b* in the cooling water circulation circuit 1 at a location closer to the radiator R than the water pump $4_2$. A heater unit 8 is provided in the middle of the passage 6. A control valve 9 and a transmission oil heat exchanger 10 are provided in sequence from the upstream side in the middle of the other passage 7.

A radiator fan 11 adjacent the radiator R is controlled in an on-off manner by a fan switch 12 which is disposed adjacent the outlet of the radiator R. When the temperature of water in the outlet of the radiator R becomes equal to or higher than a predetermined value, the radiator fan 11 is operated.

The variable flow rate control valve 37 is controlled by a control means 14 comprising a computer. Connected to the control means 14 are an outlet water temperature detector 15 for detecting an engine outlet water temperature $T_{WO}$ in the cooling water circulation circuit 1, an inlet water temperature detector 16 for detecting an engine inlet water temperature $T_{WI}$ in the cooling water circulation circuit 1, an engine revolution number or engine speed detector 21 for detecting the engine speed $N_E$, an intake pressure detector 22 for detecting the engine intake pressure $P_B$ such as the pressure in the intake manifold or the like, and a knocking detector 24 for detecting the knocking by the vibration of the engine E.

The control means 14 controls the operation of the variable flow rate control valve 37 in accordance with the temperatures $T_{WO}$ and $T_{WI}$, the engine speed $N_E$, the engine intake pressure $P_B$ and an output from the knocking detector 24.

Figure 18:
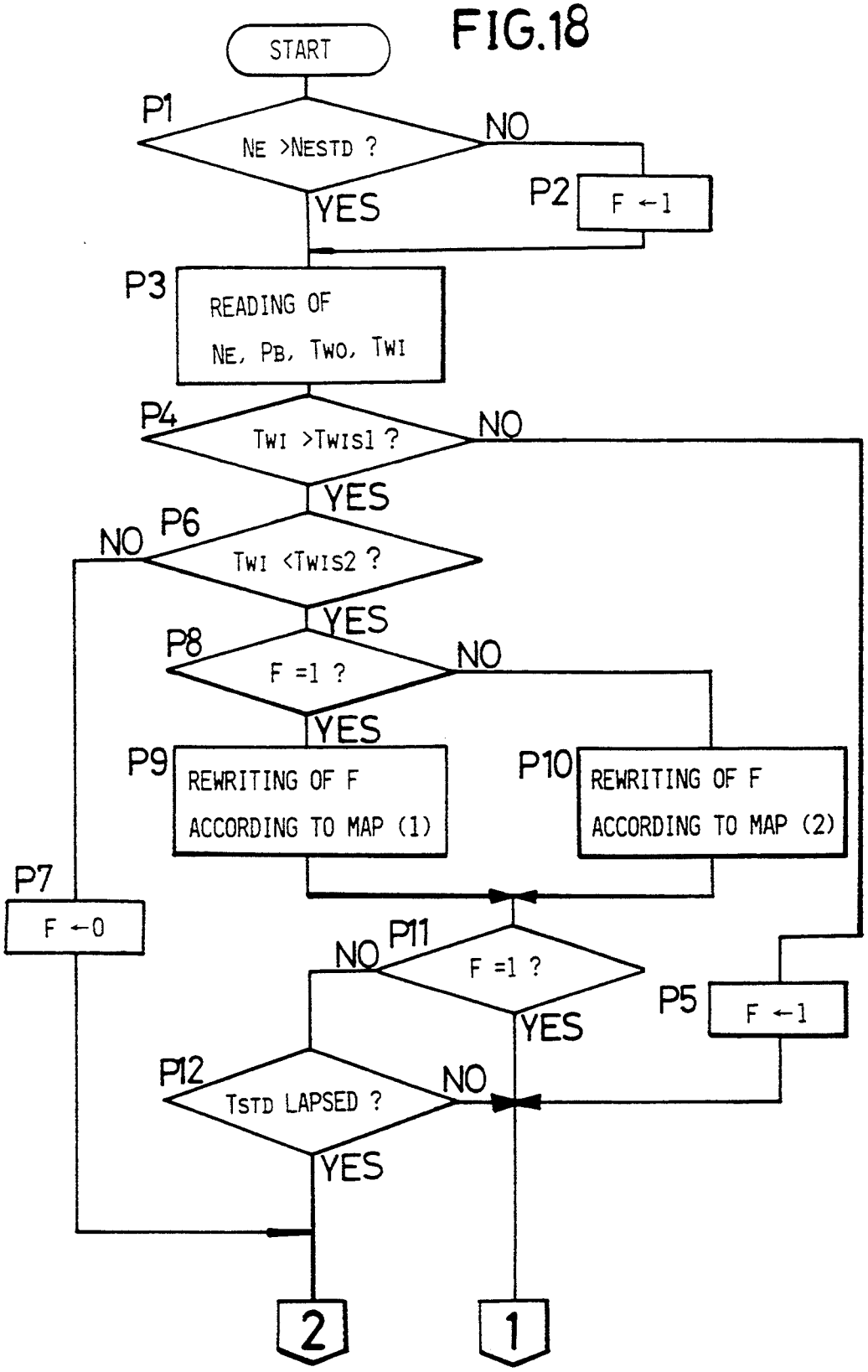
FIGS. 18 to 21 are continuing portions of a flow chart illustrating a procedure for controlling a variable flow rate control valve.

FIGS. 18 to 21 illustrate a flow chart for the control procedure established in the control means 14 to control the operation of the variable flow rate control valve 37. Referring first to FIG. 18, at a first step P1, it is judged whether or not the engine E has been brought into a stabilized state after starting, by the fact whether or not the engine speed $N_E$ has become a value exceeding a preset engine speed $N_{ESTD}$. If $N_E \leqq N_{ESTD}$, the processing is advanced to a second step P2 on the basis of the decision that the engine is in its started state. At the second step P2, a flag F is set at "1", progressing to a third step P3. On the other hand, if it has been confirmed at the first step P1 that $N_E > N_{ESTD}$, the processing is advanced to a third step P3 to bypass the second step P2.

At the third step P3, the engine speed $N_E$, the engine intake pressure $P_B$, the engine outlet water temperature $T_{WO}$ and the engine inlet water temperature $T_{WI}$ are read as parameters. At a next fourth step P4, it is judged whether or not the engine inlet water temperature $T_{WI}$ exceeds a first preset temperature $T_{WIS1}$ ($T_{WI} > T_{WIS1}$). This first preset temperature $T_{WIS1}$ is set, for example, at 60° C. at which it can be decided that the warming-up of the engine is completed. If it is decided at the fourth step P4 that the $T_{WI} \leqq T_{WIS1}$, the flag F is set at "1" progressing to a 13th step P13 (see FIG. 19). On the other hand, if it is decided at the fourth step P4 that $T_{WI} > T_{WIS1}$, the processing is advanced to a sixth step P6.

At the sixth step P6, it is judged whether or not the engine inlet water temperature $T_{WI}$ is lower than a second preset temperature $T_{WIS2}$ ($T_{WI} < T_{WIS2}$). This second preset temperature $T_{WIS2}$ is set, for example, at 90° C. at which it can be decided that the engine is in an overheated state. If it is decided at the sixth step P6 that $T_{WI} < T_{WIS2}$, the processing is advanced to a seventh step P7, at which the flag F is set at "0" progressing to a 22nd step P22 (see FIG. 20). On the other hand, if it is decided at the sixth step P6 that $T_{WI} < T_{WIS2}$ the processing is advanced to an eighth step P8.

At the eighth step P8, it is judged whether or not the flag F is at "1". If F=1, the processing is advanced to a ninth step P9. If F=0, the processing is advanced to a tenth step P10.

Figure 22:
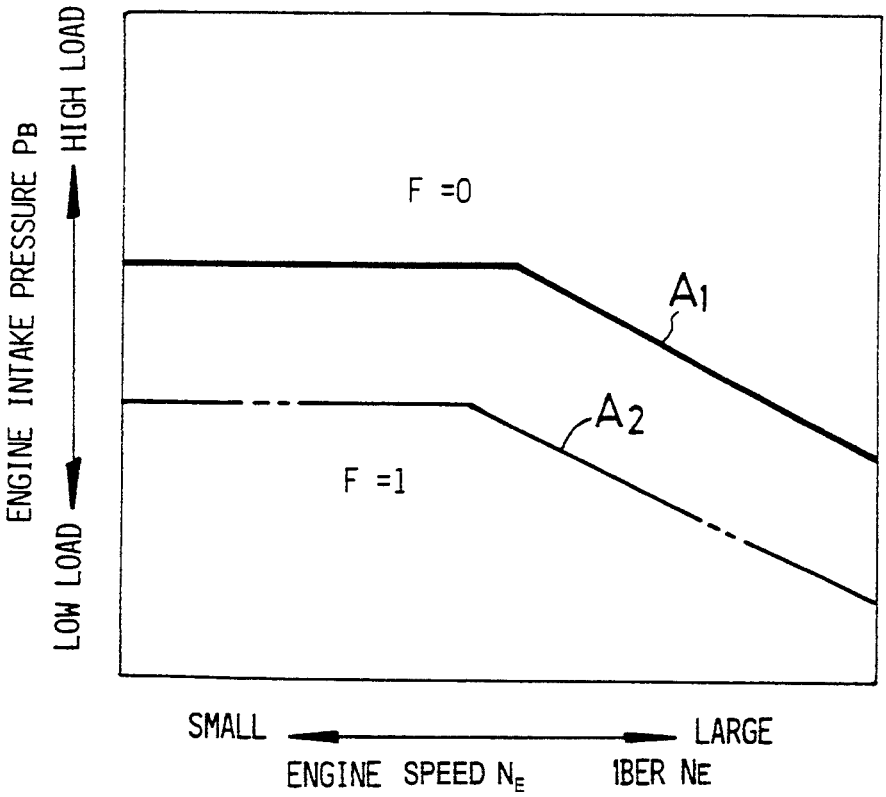
FIG. 22 is a first map of the relationship to cause the flag to be established in accordance with the engine speed and the engine intake pressure.
Figure 23:
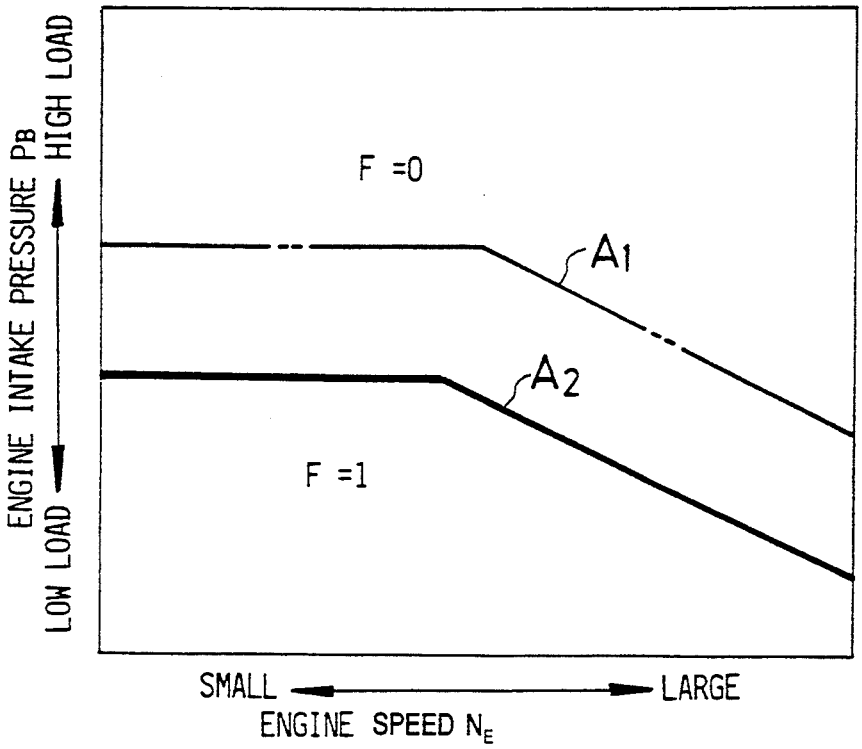
FIG. 23 is a second map of the relationship to cause the flag to be established in accordance with the engine speed and the engine intake pressure.

At the ninth step P9, the flag F is searched according to a first map shown in FIG. 22, and the flag F is reset on the basis of the result of such search. At the tenth step P10, the flag F is searched from a second map shown in FIG. 23, and the flag F is reset on the basis of the result of such search. Both the first and second maps are defined to provide a region of the flag F equal to "0" and a region of the flag F equal to "1" on the basis of the engine speed $N_E$ and the engine intake pressure $P_B$. In the first map, a boundary line $A_1$ dividing the first map into the region of F=0 and the region of F=1 is established at a level of the intake pressure $P_B$ higher than that of a boundary line $A_2$ dividing the second map into the region of F=0 and the region of F=1. That is, a hysteresis is established in rewriting the flag F on the basis of the engine speed $N_E$ and the engine intake pressure $P_B$.

After completion of the processing at the ninth and tenth steps P9 and P10, it is judged whether or not the flag is at "1" at an 11th step P11. If F=1, the processing is advanced to a 13th step P13. If F=0, the processing is advanced to a 12th step P12.

At the 12th step P12, it is judged whether or not a predetermined time $T_{STD}$ has lapsed from a time point when the flag has become "0". If the predetermined time $T_{STD}$ has still not lapsed, the processing is advanced to a 13th step P13. If the predetermined time $T_{STD}$ has been lapsed, the processing is advanced to a 22th step P22.

Figure 19:
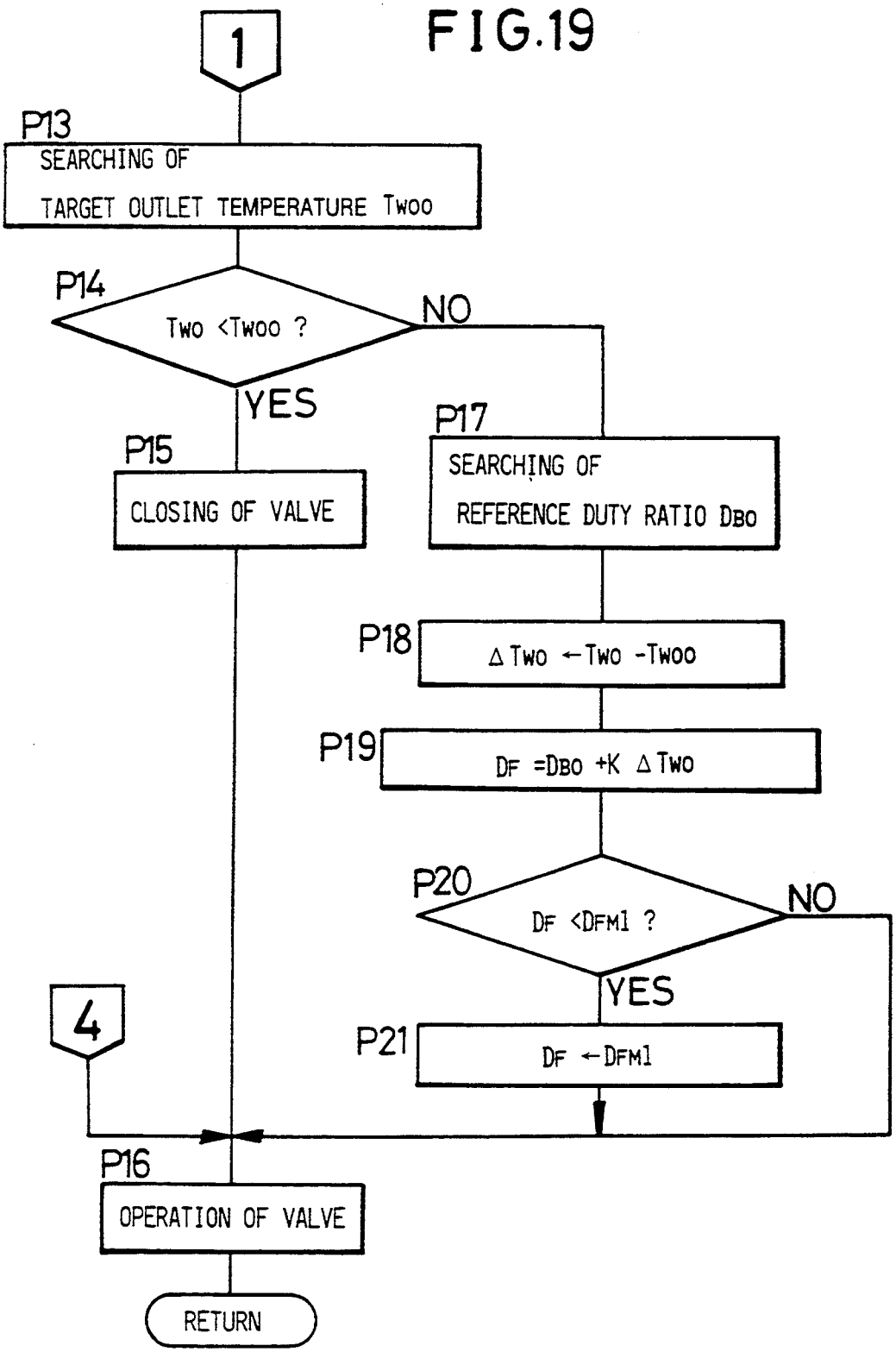

Referring to FIG. 19, at the 13th step P13, a target outlet temperature $T_{WO0}$ is searched from a map which has been established on the basis of the engine speed $N_E$ and the engine intake pressure $P_B$. If it is decided at a 14th step P14 that the engine outlet water temperature $T_{WO}$ is lower than the target outlet temperature $T_{WO0}$ ($T_{WO}<T_{WO0}$), the opening degree of the variable flow rate control valve 37 is determined to need to be at a full closed level at a 15th step P15, and the variable flow rate control valve 37 is operated at a 16th step P16.

If it is decided at the 14th step P14 that $T_{WO}\geqq T_{WO0}$, the feedback control is carried out at 17th to 21st steps P17 to P21. First, at the 17th step P17, a reference duty ratio $D_{BO}$ is searched from a map which has previously been established in correspondence to the target outlet temperature $T_{WO0}$. More specifically, the opening degree of the variable flow rate control valve 37 of the electromagnetic type is varied by controlling the duty ratio of energization of a solenoid. At the 17th step P17, the duty ratio $D_{BO}$ as a criterion is provided. A difference $\Delta T_{WO}$ ($=T_{WO}-T_{WO0}$) between the engine outlet water temperature $T_{WO}$ and the target outlet temperature $T_{WO0}$ is calculated at a 18th step P18. A feed-back control value $D_F$ is calculated as ($D_{BO}+K\cdot\Delta T_{WO}$) at a 19th step P19, wherein K is a gain.

At a 20th step P20, it is judged whether or not the feed-back control value $D_F$ obtained at the 19th step P19 is less than an acceptable minimum value $D_{FM1}$. If $D_F<D_{FM1}$, the feed-back control value $D_F$ is increased to become equal to an acceptable minimum value $D_{FM1}$ (i.e., $D_F=D_{FM1}$ is established) at a 21st step P21, progressing to the 16th step P16. On the other hand, if $D_F\geqq D_{FM1}$, the processing is advanced to the 16th step P16 to bypass the 21st step P21.

Figure 20:
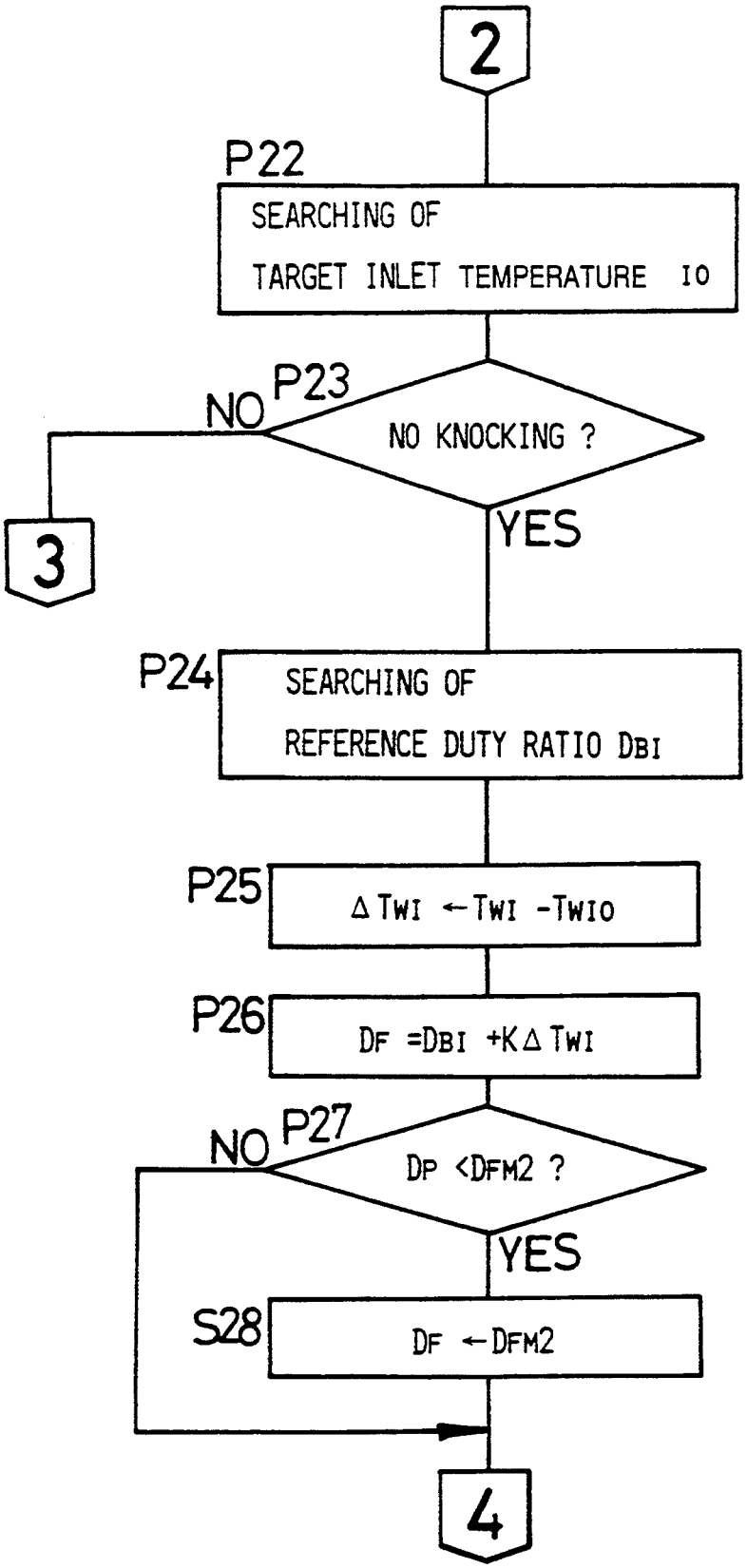

At a 22nd step P22 in FIG. 20, a target inlet temperature $T_{WIO}$ is searched from a map which has previously been established on the basis of the engine speed $N_E$ and the engine intake pressure $P_B$. At a 23rd step, it is judged whether or not there is a knocking phenomenon produced, i.e., whether or not there is no knocking detected by the knocking detector 23. If it is decided that there is the knocking produced, the processing is advanced to a 29th step P29 (see FIG. 21). If it is decided that there is no knocking produced, the processing is advanced to a 24th step P24.

At the 24th to 28th steps P24 to P28, the feed-back control according to the target inlet temperature $T_{WIO}$ is carried out. At the 24th step P24, a reference duty ratio $D_{BI}$ is searched from a map which has previously been established in correspondence to the target inlet temperature $T_{WIO}$. A difference $\Delta T_{WI}$ ($=T_{WI}-T_{WI0}$) between the engine inlet water temperature $T_{WI}$ and the target inlet temperature $T_{WI0}$ is calculated at a 25th step P25. A feed-back control value $D_F$ is calculated as ($D_{BI}+K\cdot\Delta T_{WI}$) at a 26th step P19, wherein K is a gain.

At a 27th step P27, it is judged whether or not the feed-back control value $D_F$ obtained at the 26th step P26 is less than an acceptable minimum value $D_{FM2}$. If $D_F<D_{FM2}$, then $D_F=D_{FM2}$ is established at a 28th step P28, progressing to the 16th step P16 (see FIG. 19). If $D_F\geqq D_{FM2}$ in step P27, the processing is advanced to the 16th step P16 to bypass the 28th step P28.

Figure 21:
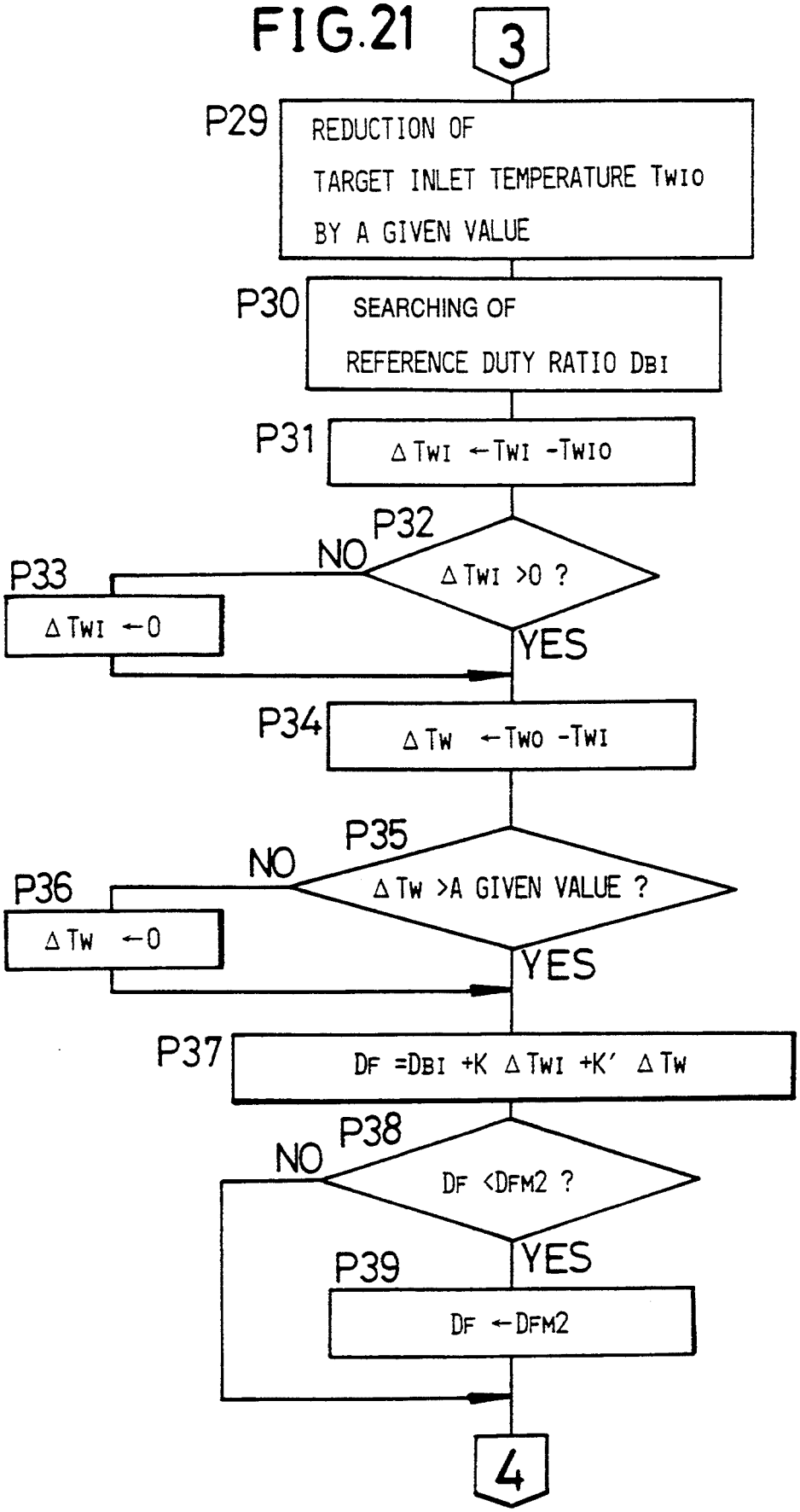

FIG. 21 illustrates the control procedure carried out at 29th to 39th steps P29 to P39, when there is a knocking produced. At the 29th step P29, the target inlet temperature $T_{WIO}$ is decreased by a given value (e.g., 3° C.) and at a 30th step P30, a reference duty ratio $D_{BI}$, is searched on the basis of the decreased target inlet temperature $T_{WIO}$. Then, a difference $\Delta T_{WI}$ ($=T_{WI}-T_{WIO}$) between the engine inlet water temperature $T_{WI}$ and the target inlet temperature $T_{WIO}$ is calculated at a 31st step P31, and it is judged at a 32nd step whether or not the difference $\Delta T_{WI}$ is positive ($\Delta T_{WI}>0$). If $\Delta T_{WI}\leqq 0$, $\Delta T_{WI}>0$ is established at a 33rd step P33, progressing to a 34th step P34. If $\Delta T_{WI}>0$ the processing is advanced to a 34th step P34 to bypass the 33rd step P33.

At the 34th step P34, a difference $\Delta T_W$ ($=T_{WO}-T_{WI}$) between the engine outlet water temperature $T_{WO}$ and the engine inlet water temperature $T_{WI}$ is calculated. Then, it is judged at a next 35th step whether or not the temperature difference $\Delta T_W$ exceeds a given value. If it is decided that $\Delta T_W\leqq$ the given value, the temperature difference $\Delta T_W$ is increased to become equal to the given value ($\Delta T_W=$ the given value ) at a 36th step P36, then progressing to a 37th step P37. If it is decided that $\Delta T_W>$ the given value, the processing is advanced to a 37th step to bypass the 36th step P36.

At the 37th step, a feed-back control value $D_F$ is calculated as ($D_{BI}+K\cdot\Delta T_{WI}+K'\cdot\Delta T_W$), wherein K' is a gain.

At a 38th step, it is judged whether or not the feed-back control value $D_F$ obtained at the 37th step P37 is less than an acceptable minimum value $D_{FM2}$. If $D_F<D_{FM2}$ the relations, $D_F=D_{FM2}$, is established in a 39th step P39, the procedure then progresses to the 16th step P16 (see FIG. 19). If $D_F\geqq D_{FM2}$, the processing is advanced to the 16th step to bypass the 39th step.

Such control procedure now will be summarized. After starting of the engine, in a lower water temperature level in which the inlet water temperature $T_{WI}$ is equal to or lower than the first preset temperature $T_{WIS1}$ (e.g., 60° C.) the control using, as a target value, a target outlet temperature $T_{WO0}$ determined by the engine speed $N_E$ and the engine intake pressure $P_B$ is carried out according to the procedure for the 13th to 21st steps P13 to P21. More specifically, when the engine outlet water temperature $T_{WO}$ is lower than the target outlet temperature $T_{WO0}$ determined by the engine speed $N_E$ and the engine intake pressure $P_B$, the variable flow rate control valve 37 is brought into its fully closed state. When the engine outlet water temperature $T_{WO}$ becomes equal to or higher than the target outlet temperature $T_{WO0}$, the opening degree of the variable flow rate control valve 37 is determined by the feed-back control using the target outlet temperature $T_{WO0}$ as the target value.

In a condition in which there is no knocking phenomenon produced in a higher water temperature level in which the engine inlet water temperature $T_{WI}$ is equal to or higher than the second preset temperature $T_{WIS2}$ (e.g., 90° C.) the feed-back control using a target outlet temperature $T_{WO0}$ determined by the engine speed $N_E$ and the engine intake pressure $P_B$ as a target value is carried out according to the procedure for the 22nd to 28th steps P22 to P28.

Further, a mean water temperature level is established in which the engine inlet water temperature $T_{WI}$ exceeds the first preset temperature $T_{WIS1}$ and is lower than the second preset temperature $T_{WIS2}$. In this mean water temperature level, a control using a target outlet temperature $T_{WO0}$ as a target value is carried out in a low load condition according to the procedure for the 13th to 21st steps P13 to P21. In a high load condition and when there is no knocking produced, a feed back control using a target inlet temperature $T_{WIO}$ determined by the engine speed $N_E$ and the engine intake pressure $P_B$ as a target value is carried out according to the procedure for the 22nd to 28th steps P22 to P28. If a knocking is produced during the feed-back control using the target inlet temperature $T_{W10}$ as the target value, a feed back control of the variable flow rate control valve 37 is carried out according to the procedure for the 29th to 39th steps P29 to P39, so that the target inlet temperature $T_{WIO}$ reduced by the given value is brought into the target value, and the temperature difference $\Delta T_W$ between the engine outlet temperature $\Delta T_{WO}$ and the engine inlet temperature $T_{WI}$ is decreased.

Moreover, in the mean water temperature level, a hysteresis is established when the lower and higher load conditions are switched over from one to another, but also, when the lower load condition is switched over to the higher load condition, the control using the target inlet temperature $T_{WIO}$ as the target value can be started only after a lapse of a given time $T_{STD}$ from the time point when the higher load condition is reached.

The operation of the third embodiment now will be described. In the engine warming-up course in which the engine inlet water temperature $T_{WI}$ is lower than the first preset temperature $T_{WIS1}$, the opening degree of the variable flow rate control valve 37 is controlled by use of the target outlet temperature $T_{WOO}$ as the target value. The variable flow rate control valve 37 is in its closed state, until the engine outlet water temperature $T_{WO}$ reaches the target outlet temperature $T_{WOO}$. In this case, the cooling water is permitted to flow through the riser passage 36, but the amount of water discharged from the water pump $4_2$ is extremely small, because of a relative large resistance to the flowing through the riser passage 36. Thus, the amount of water flowing through the engine E is extremely small, thereby providing an early increase in the temperature of the engine oil, the shortening of the warming-up time and reductions in cooling loss and in friction loss.

When the engine outlet water temperature $T_{WO}$ is increased to a certain extent, the increase in the temperature of the oil in the transmission can be provided by opening the control valve 9, thereby further reducing the friction loss. The amount of water introduced from the radiator R is increased by gradually increasing the opening degree of the variable flow rate control valve 37.

Figure 24:
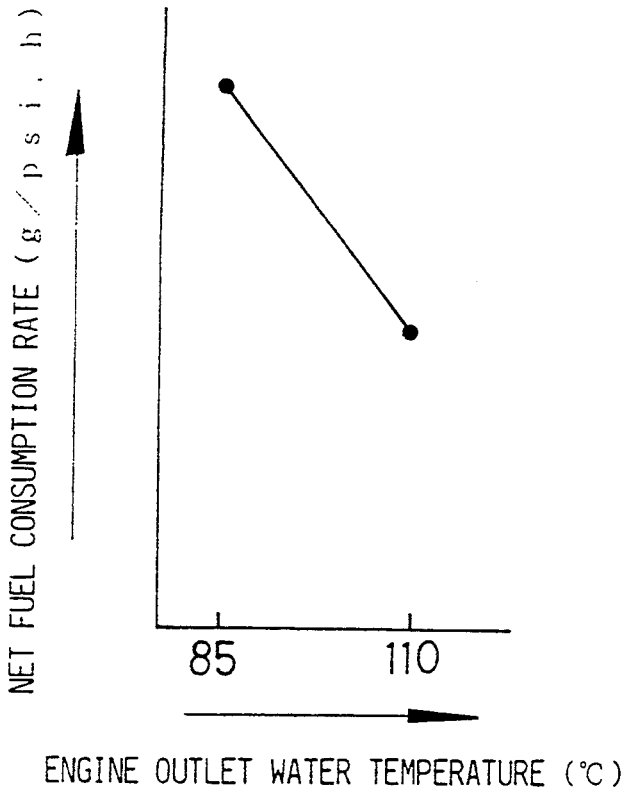
FIG. 24 is a graph illustrating the net fuel consumption rate based on the engine outlet water temperature.
Figure 25:
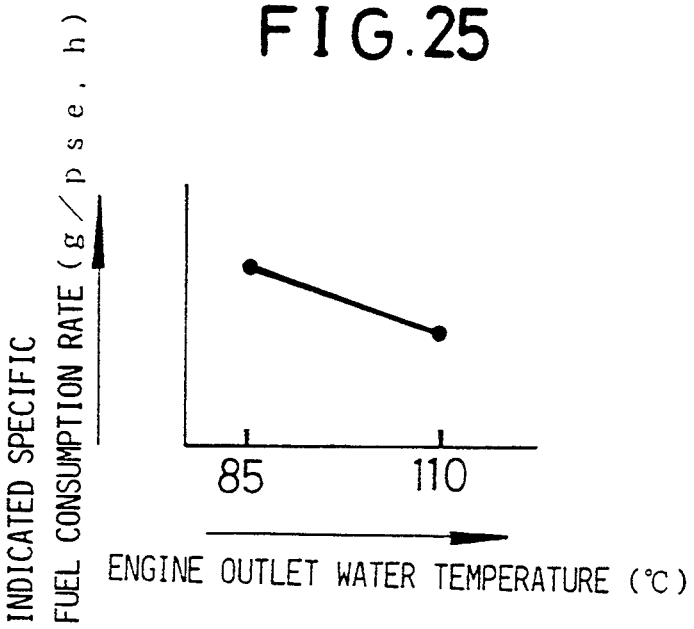
FIG. 25 is a graph illustrating the indicated specific fuel consumption rate according to the engine outlet water temperature.
Figure 26:
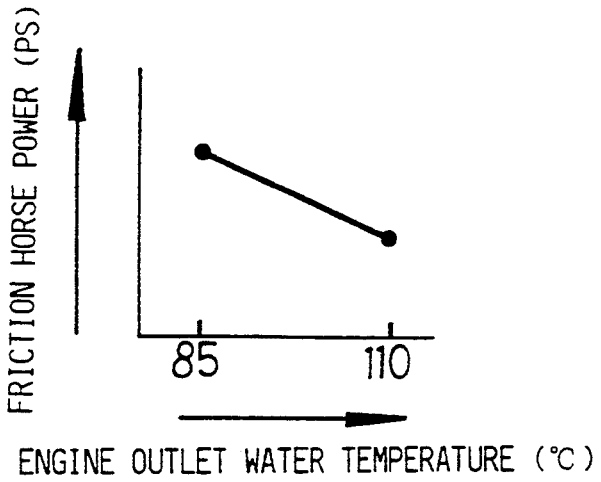
FIG. 26 is a graph illustrating the friction horsepower according to the engine outlet water temperature.

In this case, the setting of the target outlet temperature $T_{WOO}$ at a relatively high value, e.g., 110° C. ensures that the net fuel consumption rate and the indicated specific fuel consumption rate can be reduced with the reduction in cooling loss, as shown in FIGS. 24 and 25, and the friction loss can be reduced, as shown in FIG. 26. In addition, the unburned hydrocarbon in the exhaust gas can be reduced to improve the nature of the exhaust gas.

Figure 27:
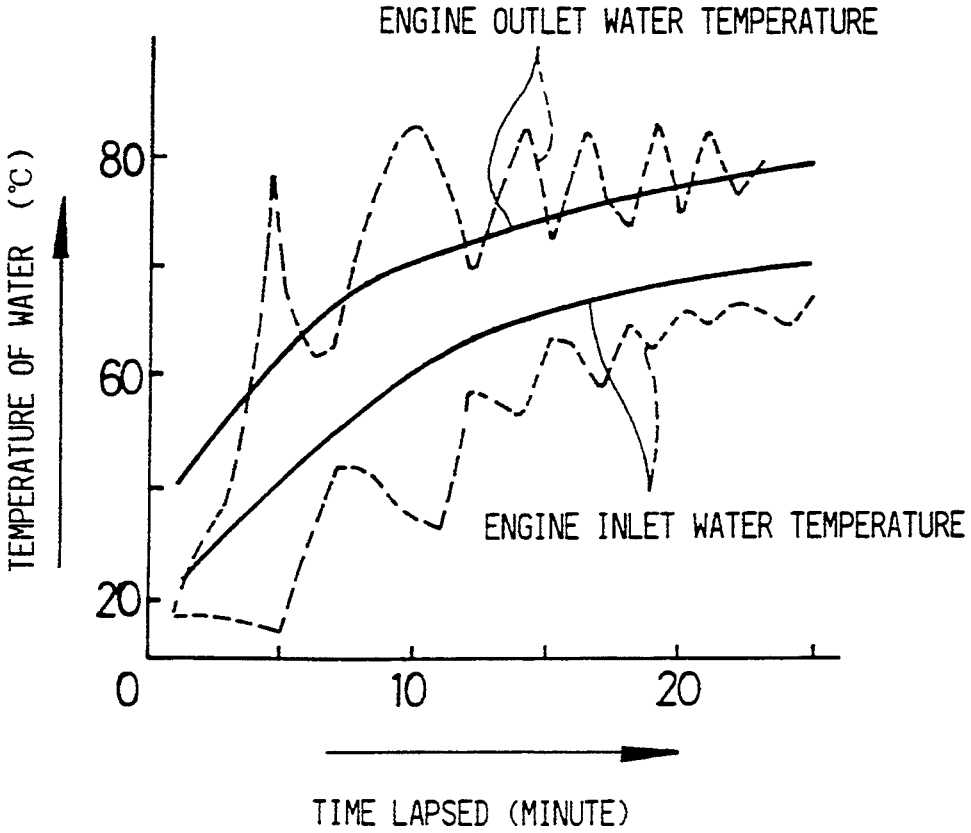
FIG. 27 is a diagram illustrating one example of the course of variation in temperature of water.

After the engine outlet temperature $T_{WO}$ once exceeds the target outlet temperature $T_{WOO}$, the minimum opening degree of the variable flow rate control valve 37 is maintained, so that the amount of water flowing through the engine E cannot be substantially varied, and the temperature of the water is stably varied with time, as shown by a solid line in FIG. 27, thereby enabling a stable operation of the engine. In contrast, when the minimum opening degree of the variable flow rate control valve 37 is not defined, the temperature of the water is substantially varied, as shown by a dashed lines in FIG. 27 and as a result, it is difficult to stably operate the engine.

Figure 28:
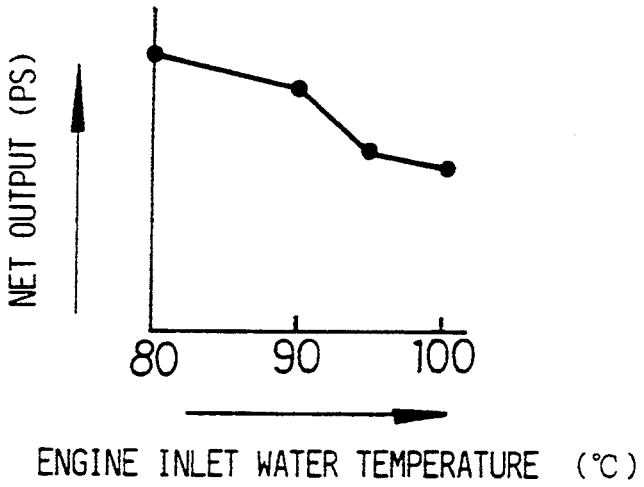
FIG. 28 is a graph illustrating an output characteristic according to the engine inlet water temperature.
Figure 29:
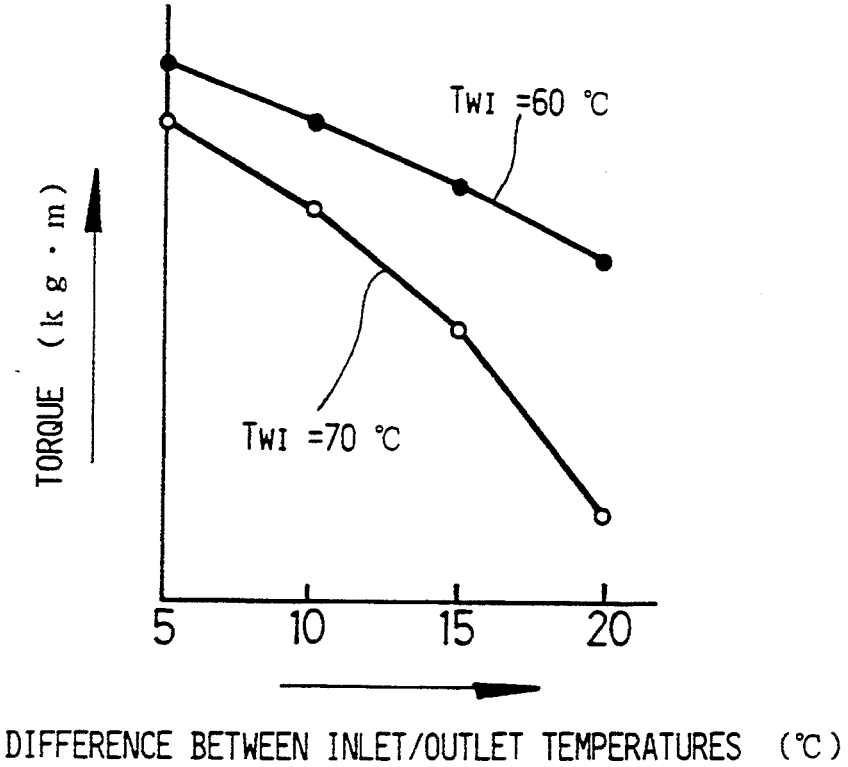
FIG. 29 is a graph illustrating a torque characteristic according to the outlet/inlet water temperatures.

The mean water temperature level in which the engine inlet temperature $T_{WI}$ exceeds the first preset temperature $T_{WIS1}$ and is lower than the second preset temperature $T_{WIS2}$ is established after completion of the warming-up of the engine. In this mean water temperature level, the state for controlling the opening degree of the variable flow rate control valve 37 to bring the engine outlet water temperature $T_{WO}$ into the target outlet temperature $T_{WO}$ during the operation of the engine at a low load and the state for controlling the opening degree of the variable flow rate control valve 37 to bring the engine inlet water temperature $T_{WI}$ into the target inlet temperature $T_{TWIO}$ during the operation of the engine at a high load are switched over from one to another. This makes it possible to achieve a reduction in fuel consumption rate and to provide a good nature of exhaust gas during the low load operation of the engine in the same manner as in the above-described warming-up of the engine. On the other hand, during the high load operation of the engine, an increase in output can be achieved by providing the control on the basis of the target inlet temperature $T_{WIO}$ determined in accordance with the engine speed $N_E$ and the load. More specifically, during the operation of the engine at a high engine speed and a high load, the increase in output can be achieved, as shown in FIG. 28, by previously setting the target inlet temperature $T_{WIO}$, for example, at 80° to 90° C. During the operation of the engine at low to medium engine speeds and a high load, the increase in output torque can be achieved, as shown in FIG. 29, by previously setting the target inlet temperature $T_{WIO}$, for example, at 60° C. Thus, a more precise control can be carried out in accordance with the operational condition of the engine.

Figure 30:
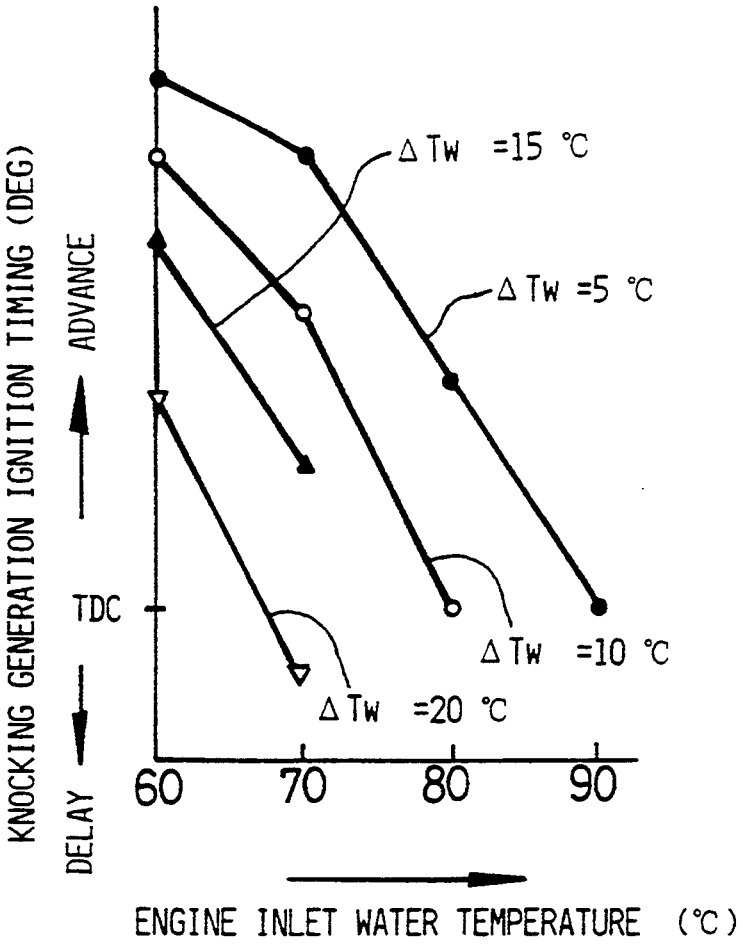
FIG. 30 is a graph illustrating a knocking generation ignition timing characteristic based on the temperature of water.

It is known that when the engine is brought into the condition of high load operation, the engine knocking is difficult to generate, if the engine inlet water temperature $T_{WI}$ is lower and the difference $\Delta T_W$ between the engine outlet water temperature $T_{WO}$ and the engine inlet water temperature $T_{WI}$ is smaller, as shown in FIG. 30. When the knocking is detected by the knocking detector 24, the opening degree of the variable flow rate control valve 37 is controlled, so that the target inlet temperature $T_{WIO}$ is reduced, and the difference $\Delta T_W$ between the engine outlet water temperature $T_{WO}$ and the engine inlet water temperature $T_{WI}$ is decreased, and as a result, the knocking is difficult to generate. Therefore, it is possible to promptly eliminate the knocking phenomenon once it has been generated, without provision of a retard of ignition timing and a richening of a fuel-air mixture.

Figures 31A, 31B, 31C:
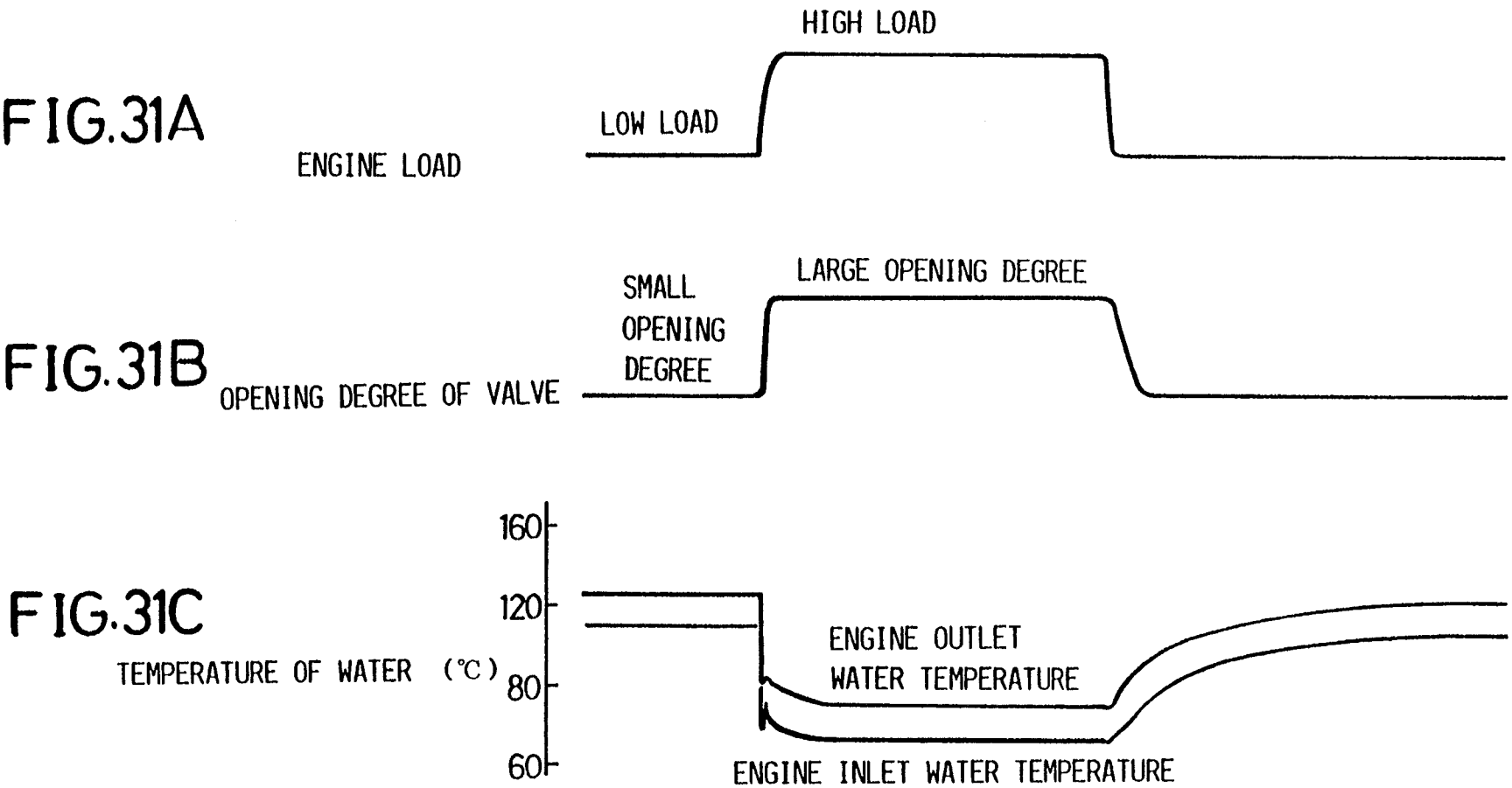
FIGS. 31A to 31C are diagrams illustrating variations in the opening degree of the variable flow rate control valve and in temperature of water in accordance with the variation in load.

Further, in the mean water temperature level, when the engine load is varied as shown in FIG. 31A, the opening degree of the variable flow rate control valve 37 is varied as shown in FIG. 31B. In accordance with this, the temperature of water is varied as shown in FIG. 31C. When the engine load is changed from a low level to a high level, a problem of an overshoot or the like as shown in FIG. 31C cannot occur. When the engine load is changed from the high level to the low level, the opening degree of the variable flow rate control valve 37 is varied with a delay toward the closed side, and a sudden undershoot cannot be produced, because of the hysteresis established. However, if the control of the variable flow rate control valve 37 is immediately changed to the control using the target inlet temperature $T_{WIO}$ as the target value in response to the changing of the engine load from the low load to the high load, when the control using the target outlet temperature $T_{WOO}$ as the target value is being carried out during the operation of the engine at the low load in the mean water temperature level, a lot of time is taken until cooling water having a low temperature is introduced into the engine E and returned. Thereupon, it is judged at the 12th step P12 in FIG. 18 whether or not the predetermined time has lapsed from the time point when the engine load has been changed from the low load to the high load. Until the predetermined time has lapsed, the control using the target inlet temperature $T_{WIO}$ as the target value is not started. This causes the temperature of the engine E to be increased slightly, but the above-described problem of the time can be accommodated by previously establishing the first map shown in FIG. 22 as well as the second map shown in FIG. 23, so that such increase in the temperature of the engine E is acceptable.

Moreover, in this cooling system, the variable flow rate control valve 37 is mounted in the middle of the passage 1*a* interconnecting the outlet of the engine E and the radiator R to constitute a portion of the cooling water circulation circuit 1 and therefore, a bypass passage conventionally provided to bypass the radiator R can be eliminated, thereby reducing the amount of water carried in the cooling water circulation circuit 1 to provide an improvement in warming-up property and a reduction in weight.

Although several embodiments of the present invention have been described in detail, it will be understood that the present invention is not intended to be limited to these embodiments, and various minor modifications in design can be made without departing from the spirit and scope of the invention defined in claims.

For example, the riser passage 36 in the third embodiment can be omitted. In this case, the 14th and 15th steps P14 and P15 in the flow chart in FIG. 19 are unnecessary, and the processing is advanced from the 13th step P13 to the 17th step P17.

What is claimed is:

1. An engine cooling system comprising a cooling water circulation circuit interconnecting an engine body and a radiator, a bypass circuit connected to the cooling water circulation circuit to bypass the radiator, an electric-powered variable displacement water pump disposed in the cooling water circulation circuit adjacent an engine inlet, a flow rate control valve for controlling a flow rate of cooling water flowing through the radiator, an outlet water temperature detector for detecting an engine outlet water temperature in the cooling water circulation circuit, an inlet water temperature detector for detecting an engine inlet water temperature in the cooling water circulation circuit, and a control means having means operatively connected to said water pump, said flow rate control valve, said outlet water detector and said inlet water temperature detector for controlling the operation of the water pump and the flow rate control valve in accordance with the engine outlet and inlet water temperatures and an operational condition of the engine, other than said water temperatures, said operational condition including at least an engine speed.

2. An engine cooling system comprising a cooling water circulation circuit interconnecting an engine body and a radiator, a bypass circuit connected to the cooling water circulation circuit to bypass the radiator, an electric-powered variable displacement water pump disposed in the cooling water circulation circuit adjacent an engine inlet, a flow rate control valve for controlling a flow rate of cooling water flowing through the radiator, an outlet water temperature detector for detecting an engine outlet water temperature in the cooling water circulation circuit, an inlet water temperature detector for detecting an engine inlet water temperature in the cooling water circulation circuit, and a control means having means operatively connected to said water pump, said flow rate control valve, said outlet water detector and said inlet water temperature detector for controlling the operation of the water pump in accordance with at least the engine outlet water temperature and controlling the operation of the flow rate control valve in accordance with at least the engine inlet water temperature, wherein said control means is capable of performing a feed-back control of the water pump using, as a target value, a target outlet water temperature determined from at least an engine speed and an engine intake pressure as parameters, and performing a feed-back control of the flow rate control valve using, as a target value, a target inlet water temperature determined from at least the engine speed and the engine intake pressure as parameters.

3. An engine cooling system according to claim 2, wherein said control means is capable of being switched over between performing the feed-back control of the water pump, when the engine outlet water temperature is equal to or higher than a reference water temperature, and an open loop control of the water pump using a control value based on the engine outlet water temperature and the engine intake pressure, when the engine outlet water temperature is lower than said reference water temperature.

4. An engine cooling system according to claim 2, wherein said control means varies a gain in the feed-back control of the flow rate control valve in accordance with the temperature of water in the radiator and the engine inlet water temperature.

5. An engine cooling system comprising a cooling water circulation circuit interconnecting an engine body and a radiator, an electric-powered variable displacement water pump disposed in the cooling water circulation circuit adjacent an engine inlet, a water temperature detector for detecting an engine water temperature, and a control means having means operatively connected to said water pump and said water temperature detector for controlling the operation of the water pump in such a manner to switch-over a feed-back control according to the engine water temperature and an open loop control from one to another in accordance with the operational condition of the engine.

6. An engine cooling system according to claim 5, wherein said control means is capable of being switched over between performing the feed-back control, when the engine water temperature is equal to or higher than a predetermined reference water temperature, and a state for performing the open loop control, when the engine water temperature is lower than said predetermined reference water temperature.

7. An engine cooling system according to claim 6, wherein said control means has a control value previously set therein in correspondence to an acceptable minimum displacement of the water pump, which insures a substantially uniform flowing of cooling water within the engine body in conducting the open loop control, when the engine water temperature is lower than said reference water temperature.

8. An engine cooling system according to claim 5, wherein said control means performs the control of the water pump using a control value continuously varied in accordance with the engine water temperature, when the operation of the engine is stopped.

9. An engine cooling system comprising a cooling water circulation circuit interconnecting an engine body and a radiator, a variable flow rate control valve mounted in said cooling water circulation circuit, an engine inlet water temperature detector for detecting an engine inlet water temperature, an engine outlet water temperature detector for detecting an engine outlet water temperature, and a control means having means operatively connected to said control valve, said inlet water temperature detector and outlet water temperature detector, said control means being switched over between a first control state for controlling an opening degree of the variable flow rate control valve to bring the engine outlet water temperature into a target outlet temperature, when the engine inlet water temperature is in a low water temperature level, and a second control state for controlling the opening degree of the variable flow rate control valve to bring the engine inlet water temperature into a target inlet temperature, when the engine inlet water temperature is in a high water temperature level.

10. An engine cooling system according to claim 9, wherein a mean water temperature level is established between the low and high water temperature levels, and said control means is switched over between said first control state during the operation of the engine at a low load in a condition in which the engine inlet water temperature is in said mean water temperature level, and said control means switches over to said second control state during the operation of the engine at a high load in a condition in which the engine inlet water temperature is in said mean water temperature level.

11. An engine cooling system according to claim 10, further including a knocking detector connected to said control means for detecting a knocking of the engine, and wherein said control means controls the opening degree of the variable flow rate control valve so as to reduce the target inlet temperature and reduce a difference between the engine outlet water temperature and the engine inlet water temperature in response to the detection of the knocking during the operation of the engine at a high load in the mean water temperature level.

12. An engine cooling system according to claim 9, wherein said variable flow rate control valve is mounted in the middle of a first passage interconnecting an engine outlet and the radiator to constitute a portion of said cooling water circulation circuit, and a riser passage interconnecting said first passage, at a location between said engine outlet and said variable flow rate control valve, with a second passage interconnecting the radiator with an engine inlet, said riser passage including means in heat exchange relationship with an intake air throttle valve body mounted on the engine.

13. An engine cooling system according to claim 9, wherein said control means controls the circulation of the cooling water through the engine body in response to both said detected temperatures for minimizing the temperature difference between said engine outlet water temperature and said engine inlet water temperature for minimizing engine knocking.

14. An engine cooling system according to claim 13, further including a water pump disposed in the cooling water circulation circuit for circulating cooling water through the engine body and the radiator.

15. An engine cooling system according to claim 14, wherein said water pump includes means for selectively varying the rate of flow of cooling water.

16. An engine cooling system according to claim 15, wherein said control means controls the water pump and the flow rate control valve in accordance with the engine outlet and inlet water temperatures and an operational condition of the engine other than said water temperatures, said operational condition including at least an engine speed.

17. An engine cooling system according to claim 9, wherein said control means is capable of performing a feed-back control of the water pump using, as a target value, a target outlet water temperature determined from at least an engine speed and an engine intake pressure as parameters, and performing a feed-back control of the flow rate control valve using, as a target value, a target inlet water temperature determined from at least the engine speed and the engine intake pressure as parameters.

18. An engine cooling system according to claim 17, wherein said control means varies a gain in the feed-back control of the flow rate control valve in accordance with the temperature of water in the radiator and the engine inlet water temperature.

19. An engine cooling system according to claim 9, wherein said control means is capable of being switched over between performing the feed-back control of the water pump, when the engine outlet water temperature is equal to or higher than a reference water temperature, and an open loop control of the water pump using a control value based on the engine outlet water temperature and an engine intake pressure, when the engine outlet water temperature is lower than said reference water temperature.

20. An engine cooling system according to claim 19, wherein said control means has a control value previously set therein in correspondence to an acceptable minimum displacement of the water pump, which insures a substantially uniform flowing of cooling water within the engine body in conducting the open loop control, when the engine water temperature is lower than said reference water temperature.

21. An engine cooling system according to claim 19, wherein said control means performs the open loop control of the water pump using the control value continuously varied in accordance with the engine water temperature, when the operation of the engine is stopped.

22. An engine cooling system comprising a cooling water circulation circuit interconnecting an engine body and a radiator, a bypass circuit connected to the cooling water circulation circuit to bypass the radiator, an electric-powered variable displacement water pump disposed in the cooling water circulation circuit adjacent an engine inlet, a flow rate control valve for controlling a flow rate of cooling water flowing through the radiator, an outlet water temperature detector for detecting an engine outlet water temperature in the cooling water circulation circuit, an inlet water temperature detector for detecting an engine inlet water temperature in the cooling water circulation circuit, and a control means having means operatively connected to said water pump, said flow rate control valve, said outlet water detector and said inlet water temperature detector for controlling the operation of the water pump in accordance with at least the engine outlet water temperature and controlling the operation of the flow rate control valve in accordance with at least the engine inlet water temperature, wherein said control means controls the operation of the water pump in such a manner as to switch-over a feed-back control according to an engine water temperature and an open loop control from one to another in accordance with the operational condition of the engine.

23. An engine cooling system according to claim 22, wherein said control means is capable of being switched over between performing the feed-back control, when the engine water temperature is equal to or higher than a predetermined reference water temperature, and performing the open loop control, when the engine water temperature is lower than said predetermined reference water temperature.

24. An engine cooling system according to claim 23, wherein said control means has a control value previously set therein in correspondence to an acceptable minimum displacement of the water pump, which insures a substantially uniform flowing of cooling water within the engine body in conducting the open loop control, when the engine water temperature is lower than said reference water temperature.

25. An engine cooling system according to claim 22, wherein said control means performs the open loop control of the water pump using a control value continuously varied in accordance with the engine water temperature, when the operation of the engine is stopped.

26. An engine cooling system comprising a cooling water circulation circuit interconnecting an engine body and a radiator, a bypass circuit connected to the cooling water circulation circuit to bypass the radiator, an electric-powered variable displacement water pump disposed in the cooling water circulation circuit adjacent an engine inlet, a flow rate control valve for controlling a flow rate of cooling water flowing through the radiator, an outlet water temperature detector for detecting an engine outlet water temperature in the cooling water circulation circuit, an inlet water temperature detector for detecting an engine inlet water temperature in the cooling water circulation circuit, and a control means having means operatively connected to said water pump, said flow rate control valve, said outlet water detector and said inlet water temperature detector for controlling the operation of the water pump in accordance with at least the engine outlet water temperature and controlling the operation of the flow rate control valve in accordance with at least the engine inlet water temperature, wherein said control means is switched over between a first control state for controlling the opening degree of the variable flow rate control valve to bring the engine outlet water temperature into a target outlet temperature, when the engine inlet water temperature is in a low water temperature level, and a second control state for controlling the opening degree of the variable flow rate control valve to bring the engine inlet water temperature into a target inlet temperature, when the engine inlet water temperature is in a high water temperature level.

27. An engine cooling system according to claim 26, wherein a mean water temperature level is established between the low and high water temperature levels, and said control means is switched over between said first control state during the operation of the engine at a low load in condition in which the engine inlet water temperature is in said mean water temperature level, and said second control state during the operation of the engine at a high load in a condition in which the engine inlet water temperature is in said mean water temperature level.

28. An engine cooling system comprising a cooling water circulation circuit interconnecting an engine body and a radiator, a bypass circuit connected to the cooling water circulation circuit to bypass the radiator, an electric-powered variable displacement water pump disposed in the cooling water circulation circuit adjacent an engine inlet, a flow rate control valve for controlling a flow rate of cooling water flowing through the radiator, an outlet water temperature detector for detecting an engine outlet water temperature in the cooling water circulation circuit, an inlet water temperature detector for detecting an engine inlet water temperature in the cooling water circulation circuit, a control means having means operatively connected to said water pump, said flow rate control valve, said outlet water detector and said inlet water temperature detector for controlling the operation of the water pump in accordance with at least the engine outlet water temperature and controlling the operation of the flow rate control valve in accordance with at least the engine inlet water temperature, and a knocking detector connected to said control means for detecting a knocking of the engine, and wherein said control means controls the opening degree of the variable flow rate control valve so as to reduce the target inlet temperature and reduce a difference between the engine outlet water temperature and the engine inlet water temperature in response to the detection of the knocking during the operation of the engine at a high load in the mean water temperature level.

29. An engine cooling system comprising a cooling water circulation circuit interconnecting an engine body and a radiator, an electric-powered variable displacement water pump disposed in said cooling water circulation circuit adjacent an engine inlet, an engine outlet water temperature detector for detecting an engine outlet water temperature, a knocking detector for detecting a knocking of the engine, and a control means having means operatively connected to said water pump, said outlet water temperature detector and said knocking detector for performing a feed-back control of the water pump to vary a rate of cooling water circulation in accordance with the engine outlet water temperature and reducing a target value for the feed-back control when the knocking is detected, wherein said control means is capable of performing a feed-back control of the water pump using, as a target value, a target outlet water temperature determined from at least an engine speed and an engine intake pressure as parameters, and performing a feed-back control of the flow rate control valve using, as a target value, a target inlet water temperature determined from at least the engine speed and the engine intake pressure as parameters.

30. An engine cooling system according to claim 39, wherein said control means is capable of being switched over between performing the feed-back control of the water pump, when the engine outlet water temperature is equal to or higher than a reference water temperature, and an open loop control of the water pump using a control value based on the engine outlet water temperature and the engine intake pressure, when the engine outlet water temperature is lower than said reference water temperature.

31. An engine cooling system according to claim 30, wherein said control means has a control value previously set therein in correspondence to an acceptable minimum displacement of the water pump, which insures a substantially uniform flowing of cooling water within the engine body in conducting the open loop control, when the engine water temperature is lower than said reference water temperature.

32. An engine cooling system according to claim 30, wherein said control means performs the open loop control of the water pump using the control value continuously varied in accordance with the engine water temperature, when the operation of the engine is stopped.

33. An engine cooling system according to claim 29, wherein said control means varies a gain in the feed-back control of the flow rate control valve in accordance with the temperature of water in the radiator and the engine inlet water temperature.

34. An engine cooling system comprising a cooling water circulation circuit interconnecting an engine body and a radiator, an electric-powered variable displacement water pump disposed in said cooling water circulation circuit adjacent an engine inlet, an engine outlet water temperature detector for detecting an engine outlet water temperature, a knocking detector for detecting a knocking of the engine, and a control means having means operatively connected to said water pump, said outlet water temperature detector and said knocking detector for performing a feed-back control of the water pump to vary a rate of cooling water circulation in accordance with the engine outlet water temperature and reducing a target value for the feed-back control when the knocking is detected, wherein said control means is switched over between a first control state for controlling the opening degree of the variable flow rate control valve to bring the engine outlet water temperature into a target outlet temperature, when the engine inlet water temperature is in a low water temperature level, and a second control state for controlling the opening degree of the variable flow rate control valve to bring the engine inlet water temperature into a target inlet temperature, when the engine inlet water temperature is in a high water temperature level.

35. An engine cooling system according to claim 34, wherein a mean water temperature level is established between the low and high water temperature levels, and said control means is switched over between said first control state during the operation of the engine at a low load in a condition in which the engine inlet water temperature is in said mean water temperature level, and said second control state during the operation of the engine at a high load in a condition in which the engine inlet water temperature is in said mean water temperature level.

36. An engine cooling system according to claim 34, further including a knocking detector connected to said control means for detecting a knocking of the engine, and wherein said control means controls the opening degree of the variable flow rate control valve so as to reduce the target inlet temperature and reduce a difference between the engine outlet water temperature and the engine inlet water temperature in response to the detection of the knocking during the operation of the engine at a high load in the mean water temperature level.

* * * * *

UNITED STATES PATENT AND TRADEMARK OFFICE

CERTIFICATE OF CORRECTION

PATENT NO. : 5,390,632

DATED : February 21, 1995

INVENTOR(S) : HIDEHITO IKEBE ET AL.

It is certified that error appears in the above-indentified patent and that said Letters Patent is hereby corrected as shown below:

Claim 30, column 23, line 27, delete "39" and insert -- 29 --.

Signed and Sealed this

Twenty-sixth Day of December, 1995

*Attest:*

Bruce Lehman

BRUCE LEHMAN

*Attesting Officer*

*Commissioner of Patents and Trademarks*